US008993206B2

(12) United States Patent
Iwanaga et al.

(10) Patent No.: US 8,993,206 B2
(45) Date of Patent: Mar. 31, 2015

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventors: Takeshi Iwanaga, Kanagawa (JP); Masaki Hirakata, Kanagawa (JP); Hideya Katsuhara, Kanagawa (JP); Tomoya Sasaki, Kanagawa (JP); Nobuyuki Torigoe, Kanagawa (JP); Takashi Imai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 27 days.

(21) Appl. No.: 13/856,139

(22) Filed: Apr. 3, 2013

(65) Prior Publication Data

US 2013/0344422 A1 Dec. 26, 2013

(30) Foreign Application Priority Data

Jun. 22, 2012 (JP) ..... 2012-141229

(51) Int. Cl.
*G03G 5/147* (2006.01)
*G03G 5/047* (2006.01)
*G03G 5/08* (2006.01)

(52) U.S. Cl.
CPC ..... *G03G 5/14704* (2013.01); *G03G 5/14708* (2013.01); *G03G 5/047* (2013.01); *G03G 5/08* (2013.01)
USPC ..... 430/66

(58) Field of Classification Search
CPC ..... G03G 5/14704
USPC ..... 430/66, 67; 399/159
See application file for complete search history.

(56) References Cited

U.S. PATENT DOCUMENTS

| | | | | | |
|---|---|---|---|---|---|
| 4,409,309 | A | * | 10/1983 | Oka | 430/65 |
| 4,606,934 | A | * | 8/1986 | Lee et al. | 427/76 |
| 4,939,056 | A | * | 7/1990 | Hotomi et al. | 430/66 |
| 5,139,906 | A | * | 8/1992 | Doi et al. | 430/57.4 |
| 5,168,023 | A | * | 12/1992 | Mitani et al. | 430/58.1 |
| 5,268,247 | A | * | 12/1993 | Hayashi | 430/67 |
| 5,756,246 | A | * | 5/1998 | Woo et al. | 430/66 |
| 5,840,455 | A | * | 11/1998 | Ikuno et al. | 430/67 |

(Continued)

FOREIGN PATENT DOCUMENTS

| | | |
|---|---|---|
| JP | A-58-59454 | 4/1983 |
| JP | A-58-80647 | 5/1983 |

(Continued)

OTHER PUBLICATIONS

English language translation of JP 2011-197571 (Oct. 2011).*

*Primary Examiner* — Christopher Rodee
(74) *Attorney, Agent, or Firm* — Oliff PLC

(57) ABSTRACT

An electrophotographic photoreceptor includes a conductive substrate, an organic photosensitive layer that is provided on the conductive substrate, and an inorganic protective layer that is provided on the organic photosensitive layer, wherein the inorganic protective layer includes a first layer, a second layer, and a third layer in this order from the organic photosensitive layer side and satisfies the relationship of the following expression (1):

$$\rho 3 \leq \rho 1 < \rho 2 \qquad \text{Expression (1):}$$

wherein ρ1 represents a volume resistivity (Ω·cm) of the first layer, ρ2 represents a volume resistivity (Ω·cm) of the second layer, and ρ3 represents a volume resistivity (Ω·cm) of the third layer.

12 Claims, 7 Drawing Sheets

(56) References Cited

U.S. PATENT DOCUMENTS

| | | | | |
|---|---|---|---|---|
| 5,882,830 | A * | 3/1999 | Visser et al. | 430/58.25 |
| 5,910,386 | A * | 6/1999 | Yoshinaga et al. | 430/66 |
| 8,357,478 | B2 * | 1/2013 | Katsuhara et al. | 430/66 |
| 8,404,415 | B2 * | 3/2013 | Iwanaga et al. | 430/66 |
| 8,460,452 | B2 * | 6/2013 | Yagi et al. | 106/286.6 |
| 8,574,798 | B2 * | 11/2013 | Iwanaga et al. | 430/66 |
| 2002/0034701 | A1 * | 3/2002 | Morikawa et al. | 430/66 |
| 2006/0127783 | A1 * | 6/2006 | Ohira et al. | 430/64 |
| 2006/0216621 | A1 * | 9/2006 | Yamane et al. | 430/59.6 |
| 2007/0287085 | A1 * | 12/2007 | Iwanaga et al. | 430/66 |
| 2008/0254379 | A1 * | 10/2008 | Iwanaga et al. | 430/66 |
| 2009/0246665 | A1 * | 10/2009 | Wu et al. | 430/66 |

FOREIGN PATENT DOCUMENTS

| | | | | |
|---|---|---|---|---|
| JP | 62028768 | A * | 2/1987 | G03G 5/14 |
| JP | A-7-181705 | | 7/1995 | |
| JP | A-7-239565 | | 9/1995 | |
| JP | A-9-101625 | | 4/1997 | |
| JP | A-2003-27238 | | 1/2003 | |
| JP | A-2008-268266 | | 11/2008 | |
| JP | A-2011-197571 | | 10/2011 | |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2012-141229 filed Jun. 22, 2012.

BACKGROUND

1. Technical Field

The present invention relates to an electrophotographic photoreceptor, a process cartridge, and an image forming apparatus.

2. Related Art

Electrophotography is widely used for copying machines, printers, or the like. Recently, techniques have been discussed which relate to an electrophotographic photoreceptor (hereinafter, also referred to as a "photoreceptor") used for an electrophotographic image forming apparatus and in which a surface layer (protective layer) is formed on a photosensitive layer surface of the photoreceptor.

SUMMARY

According to an aspect of the invention, there is provided an electrophotographic photoreceptor including a conductive substrate; an organic photosensitive layer that is provided on the conductive substrate; and an inorganic protective layer that is provided on the organic photosensitive layer, wherein the inorganic protective layer includes a first layer, a second layer, and a third layer in this order from the organic photosensitive layer side and satisfies the relationship of the following expression (1):

$$\rho 3 \leq \rho 1 < \rho 2 \qquad \text{Expression (1):}$$

wherein $\rho 1$ represents a volume resistivity (Ω·cm) of the first layer, $\rho 2$ represents a volume resistivity (Ω·cm) of the second layer, and $\rho 3$ represents a volume resistivity (Ω·cm) of the third layer.

BRIEF DESCRIPTION OF THE DRAWINGS

Exemplary embodiments of the present invention will be described in detail based on the following figures, wherein.

DETAILED DESCRIPTION

Figure 1:
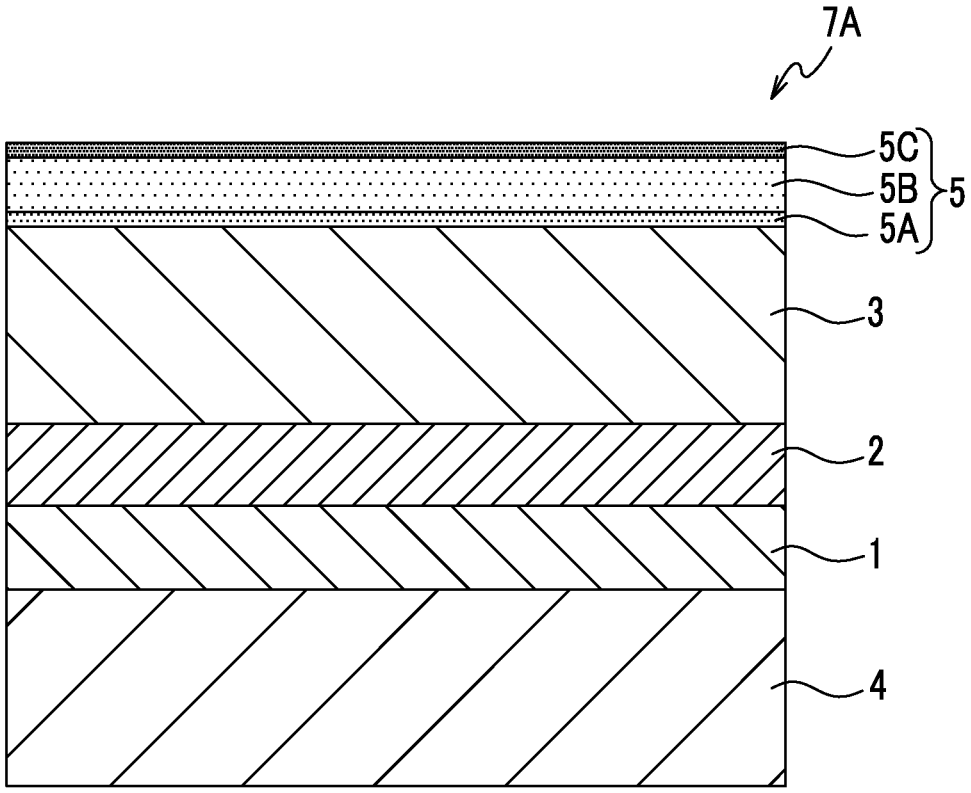
FIG. 1 is a cross-sectional view schematically illustrating a layer configuration example of an electrophotographic photoreceptor according to an exemplary embodiment of the present invention.

Hereinafter, exemplary embodiments of the present invention will be described in detail.

Electrophotographic Photoreceptor

An electrophotographic photoreceptor according to an exemplary embodiment of the present invention includes a conductive substrate; an organic photosensitive layer that is provided on the conductive substrate; and an inorganic protective layer that is provided on the organic photosensitive layer.

The inorganic protective layer includes a first layer (hereinafter, referred to as an "interfacial layer"), a second layer (hereinafter, referred to as an "intermediate layer", and a third layer (hereinafter, referred to as an "outermost layer") in this order from the organic photosensitive layer side and satisfies the relationship of the following expression (1).

$$\rho 3 \leq \rho 1 < \rho 2 \qquad \text{Expression (1):}$$

In the expression (1), $\rho 1$ represents a volume resistivity (Ω·cm) of the interfacial layer, $\rho 2$ represents a volume resistivity (Ω·cm) of the intermediate layer, and $\rho 3$ represents a volume resistivity (Ω·cm) of the outermost layer.

In the inorganic layer, the interfacial layer, the intermediate layer, and the outermost layer may be laminated so as to have clear or unclear interfaces between the respective layers.

In the electrophotographic photoreceptor according to the exemplary embodiment having the above-described configuration, image blurring and residual potential are suppressed.

The reason is not clear but is considered to be as follows.

In the related art, a technique in which an inorganic protective layer is provided on an organic photosensitive layer is known. A p-type material is widely known for a charge-transporting organic material contained in the organic photosensitive layer, and there are many cases in which the organic photosensitive layer shows p-type conductivity. On the other hand, an n-type or i-type material is widely known for a charge-transporting inorganic material contained in the inorganic protective layer, and there are many cases in which the inorganic protective layer shows n-type or i-type conductivity.

An electrophotographic photoreceptor in which an n-type or i-type inorganic protective layer is formed on a p-type organic photosensitive layer is called a negatively charged electrophotographic photoreceptor.

As described above, in such a negatively charged electrophotographic photoreceptor including a p-type organic photosensitive layer and an n-type or i-type inorganic protective layer, when a surface thereof is charged, it is considered that a force is applied to negatively charged particles (electrons) during a period between charging and exposure in a direction from a surface of the inorganic protective layer to the side of the conductive substrate (in a direction perpendicular to the surface of the inorganic protective layer). It is considered that the negatively charged particles move toward the interface between the organic photosensitive layer and the inorganic protective layer due to injection properties from a surface of the inorganic protective layer and the conductivity of the inorganic protective layer.

Next, when the negatively charged electrophotographic photoreceptor is exposed to light, positively charges (holes) of exposed portions, which are generated by light, move from the inside of the organic photosensitive layer to the surface (the interface with the inorganic protective layer) of the organic photosensitive layer during exposure and development. Accordingly, the surface potential of the electrophotographic photoreceptor is reduced, which causes a potential difference between the exposed portions and non-exposed portions. As a result, a latent image is formed. Then, development is performed.

In the negatively charged electrophotographic photoreceptor in which development is performed through the above-described operations, it is considered that it is difficult to inject the positively charges (holes), which are moved to the interface between the organic photosensitive layer and the inorganic protective layer, to the n-type or i-type inorganic protective layer and cause the holes to flow (move) through the inside of the inorganic protective layer; and as a result the holes remain in the interface (the interface on the side of the organic photosensitive layer).

On the other hand, in the such negatively charged electrophotographic photoreceptor, when defects or impurities are introduced into the inorganic protective layer to reduce a resistance in consideration of injecting properties of the negatively charges (electrons) generated by charging, it is considered that the negatively charges in the inorganic protective layer are scattered or trapped and are difficult to flow due to effects of defect or impurity level; and as a result, apart of the negatively charges remain in the inorganic protective layer. When the negatively charges remain in the interface between the organic photosensitive layer and the inorganic protective layer, it is considered that a potential difference with the positively charges remaining in the interface is large; and a residual potential is generated.

Therefore, in order to suppress the residual potential in consideration of injecting properties of the negatively charges (electrons) supplied by charging, it is preferable that the inorganic protective layer have a two-layer structure in which the resistance of a layer (outermost layer) on the surface side is reduced; and the resistance of a lower layer (a layer forming the interface with the organic photosensitive layer) in contact with the organic photosensitive layer side is increased. The reason is considered to be that defects or impurities are suppressed in the lower layer in contact with the organic photosensitive layer side to increase a resistance; and as a result, the effects of defect or impurity level are suppressed, the negatively charges are caused to easily flow through the inside of the inorganic protective layer; and the negatively charges are difficult to remain in the inorganic protective layer.

However, in the negatively charged electrophotographic photoreceptor after exposing, since an electric field is also applied in an in-plane direction (direction intersecting a thickness direction of the inorganic protective layer), it is considered that a force is applied to the negatively charges (electrons) of the non-exposed portions in both the direction facing toward the conductive substrate (direction perpendicular to the surface of the inorganic protective layer) and a direction facing toward the in-plane direction.

That is, in the inorganic protective layer having the above-described two-layer structure, when defects or impurities are suppressed in the lower layer (layer forming the interface with the organic photosensitive layer) in contact with the organic photosensitive layer side to increase a resistance, it is considered that the negatively charges (electrons) of the non-exposed portions are easy to flow in the in-plane direction; and as a result, a latent image is shifted or spread out and thus image blurring occurs.

Therefore, in the inorganic protective layer having the above-described two-layer structure, an interfacial layer, which has a lower resistance than that of the high-resistance lower layer by introducing defects or impurities thereinto, is interposed between the high-resistance lower layer and the organic photosensitive layer; and the high-resistance lower layer is set as an intermediate layer. That is, the inorganic protective layer includes the interfacial layer, the intermediate layer, and the outermost layer in this order from the organic photosensitive layer side and satisfies the resistance relationship of the expression (1).

As a result, it is considered that the intermediate layer causes the negatively charged particles to easily flow through the entire inorganic protective layer; and the interfacial layer temporarily inhibits the negatively charged particles from flowing in the in-plane direction in the vicinity of the interface between the organic photosensitive layer and the inorganic protective layer. As a result, a residual potential and image blurring are suppressed at the same time.

In addition, it is considered that the same shall be applied to a positively charged electrophotographic photoreceptor in which the conductivity relationship between an organic photosensitive layer and an inorganic protective layer are reversed (that is, a positively charged electrophotographic photoreceptor in which a p-type inorganic protective layer is formed on an n-type or i-type organic photosensitive layer).

As described above, the electrophotographic photoreceptor according to the exemplary embodiment includes the inorganic protective layer that includes the interfacial layer, the intermediate layer, and the outermost layer; satisfies the resistance relationship of the expression (1); and is formed on the organic photosensitive layer. As a result, it is considered that image blurring and a residual potential are suppressed.

A residual potential is significantly generated when the surface protective layer (the entire layer thereof) is thick (for example, from 0.4 μm to 5.0 μm). However, the residual potential is suppressed in the exemplary embodiment.

In addition, image blurring significantly occurs when an image is formed under printing conditions of a line screen frequency of, for example, from 100 lpi (lpi=lines/inch) to 600 lpi (for example, under printing conditions in which halftone dots (cluster dots) are printed in the above-described lpi range). However, image blurring is suppressed in the exemplary embodiment.

Hereinafter, the electrophotographic photoreceptor according to the exemplary embodiment will be described in detail with reference to the drawings. In the drawings, the same or corresponding components are represented by the same reference numeral, and the description thereof will not be repeated.

Figure 2:
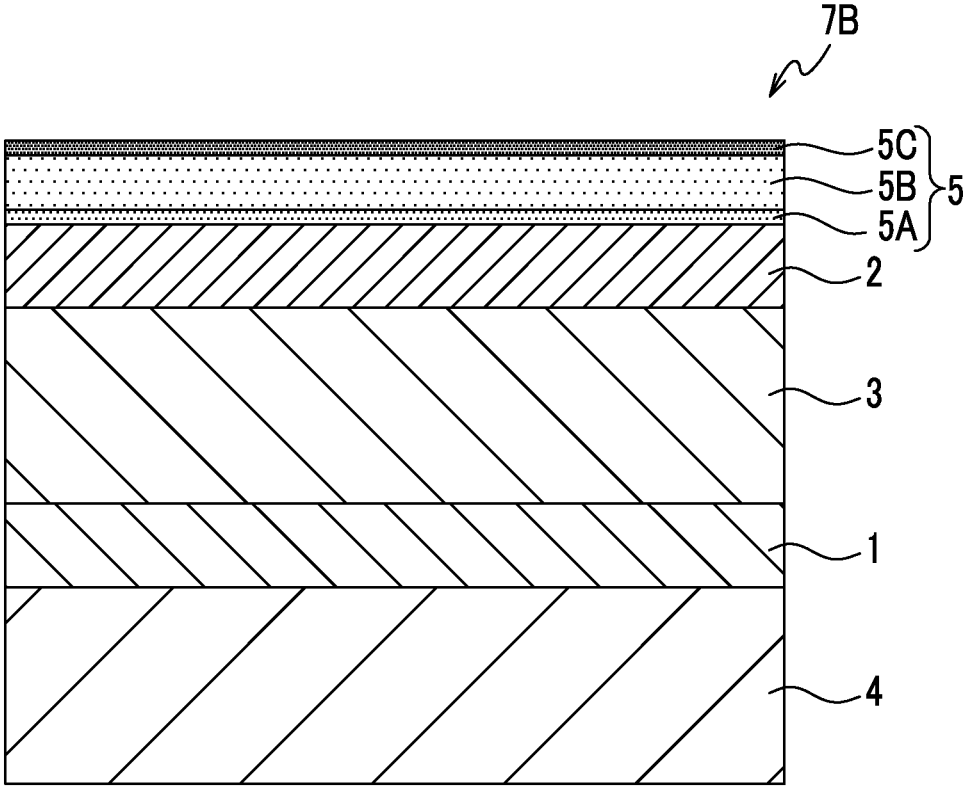
FIG. 2 is a cross-sectional view schematically illustrating another layer configuration example of the electrophotographic photoreceptor according to the exemplary embodiment.
Figure 3:
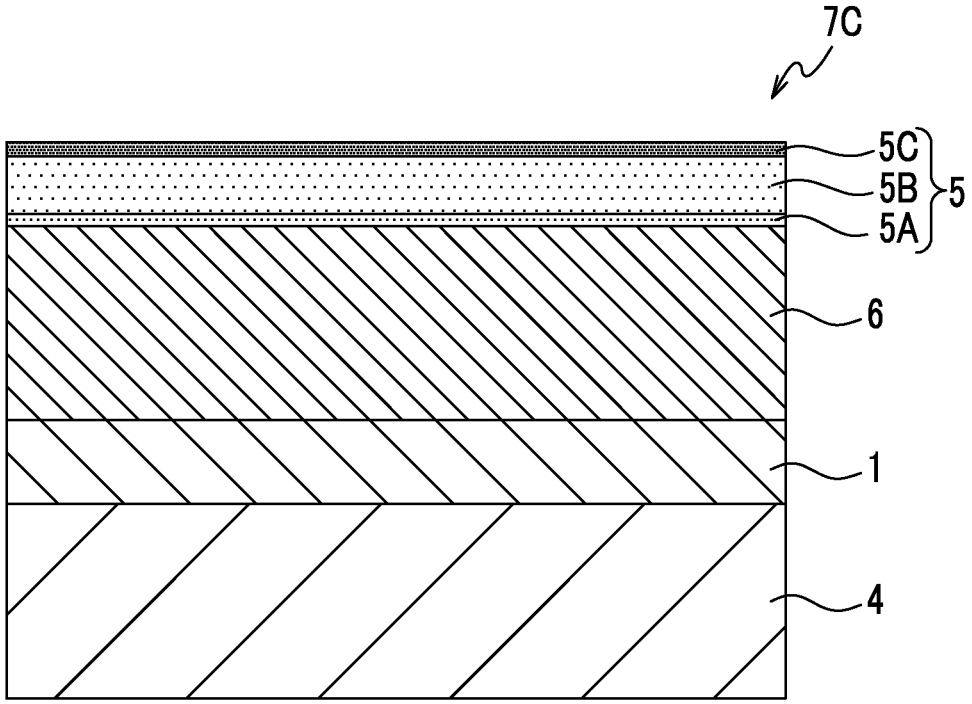
FIG. 3 is a cross-sectional view schematically illustrating another layer configuration example of the electrophotographic photoreceptor according to the exemplary embodiment.

FIG. 1 is a cross-sectional view schematically illustrating an example of the electrophotographic photoreceptor according to the exemplary embodiment. FIGS. 2 and 3 are respectively cross-sectional views schematically illustrating other examples of the electrophotographic photoreceptor according to the exemplary embodiment.

An electrophotographic photoreceptor 7A illustrated in FIG. 1 is a so-called function separation type photoreceptor (or multilayer type photoreceptor) and has a structure in which an undercoat layer 1 is provided on a conductive substrate 4; and a charge generation layer 2, a charge transport layer 3, and an inorganic protective layer 5 are formed thereon in this order. In the electrophotographic photoreceptor 7A, the charge generation layer 2 and the charge transport layer 3 form an organic photosensitive layer.

In addition, an interfacial layer 5A, an intermediate layer 5B, and an outermost layer 5C are laminated in this order from the organic photosensitive layer (charge transport layer 3) side to form the inorganic protective layer 5.

Similarly to the case of the electrophotographic photoreceptor 7A illustrated in FIG. 1, an electrophotographic photoreceptor 7B illustrated in FIG. 2 is a function separation type photoreceptor in which functions of the charge generation layer 2 and the charge transport layer 3 are separated. In addition, in an electrophotographic photoreceptor 7C illustrated in FIG. 3, a single layer (single-layer type organic photosensitive layer 6 (charge generation and charge transport layer)) contains a charge generation material and a charge-transporting organic material.

The electrophotographic photoreceptor 7B illustrated in FIG. 2 has a structure in which the undercoat layer 1 is formed on the conductive substrate 4; and the charge transport layer 3, the charge generation layer 2, and the inorganic protective layer 5 are formed thereon in this order. In the electrophotographic photoreceptor 7B, the charge generation layer 2 and the charge transport layer 3 form an organic photosensitive layer.

In addition, the interfacial layer 5A, the intermediate layer 5B, and the outermost layer 5C are laminated in this order from the organic photosensitive layer (charge generation layer 2) side to form the inorganic protective layer 5.

The electrophotographic photoreceptor 7C illustrated in FIG. 3 has a structure in which the undercoat layer 1 is formed on the conductive substrate 4; and the single-layer type photosensitive layer 6 and the inorganic protective layer 5 are formed thereon in this order.

In addition, the interfacial layer 5A, the intermediate layer 5B, and the outermost layer 5C are laminated in this order from the organic photosensitive layer (single-layer type photosensitive layer 6) side to form the inorganic protective layer 5.

In the electrophotographic photoreceptors illustrated in FIGS. 1 to 3, the undercoat layer 1 is not necessarily provided.

Hereinafter, the respective elements will be described on the basis of the electrophotographic photoreceptors 7A shown in the FIG. 1 as representative examples.

Conductive Substrate

As the conductive substrate, any one may be used if it has been used hitherto. Examples thereof include plastic films coated with a thin film (for example, metals such as aluminum, nickel, chromium, and stainless steel, and films of aluminum, titanium, nickel, chromium, stainless steel, gold, vanadium, tin oxide, indium oxide, and indium tin oxide (ITO)), paper impregnated with a conductivity imparting agent and plastic films impregnated with a conductivity imparting agent. The shape of the substrate is not limited to a cylindrical shape, and may be a sheet shape or a plate shape.

The conductive substrate may have a conductive property in which the volume resistivity is, for example, less than $10^7$ Ω·cm When a metallic pipe is used as the conductive substrate, the surface thereof may be used as it is, or may be subjected to specular machining, etching, anodization, coarse machining, centerless grinding, sand blasting, wet honing, or the like in advance.

Undercoat Layer

The undercoat layer is provided as necessary to prevent light reflection on the surface of the conductive substrate, and to prevent unnecessary carriers from flowing from the conductive substrate to the photosensitive layer.

The undercoat layer includes, for example, a binder resin, and if necessary, other additives.

Examples of the binder resin included in the undercoat layer include known polymeric resin compounds e.g., acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; charge-transporting resins having a charge transport group; and conductive resins such as polyaniline. Among them, resins insoluble in the coating solvent of the upper layer are preferably used, and phenol resins, phenol-formaldehyde resins, melamine resins, urethane resins, and epoxy resins, and the like are particularly preferably used.

The undercoat layer may contain a metallic compound such as a silicon compound, an organic zirconium compound, an organic titanium compound, and an organic aluminum compound.

The ratio of the metallic compound to the binder resin is not particularly limited, and may be set so that desired electrophotographic photoreceptor characteristics are obtained.

Resin particles may be added to the undercoat layer in order to adjust surface roughness. Examples of the resin particles include silicone resin particles and cross-linked polymethylmethacrylate (PMMA) resin particles. After forming the undercoat layer, the surface thereof may be polished in order to adjust surface roughness. Examples of the polishing method include buff polishing, sand blasting, wet honing, and grinding.

Here, examples of the configuration of the undercoat layer include a configuration in which at least a binder resin and conductive particles are contained. The conductive particles may have a conductive property in which the volume resistivity is, for example, less than $10^7$ Ω·cm.

Examples of the conductive particles include metallic particles (aluminum particles, copper particles, nickel particles, silver particles, and the like), conductive metallic oxide particles (antimony oxide particles, indium oxide particles, tin oxide particles, zinc oxide particles, and the like), and conductive substance particles (carbon fiber particles, carbon black particles, and graphite powder particles). Among them, conductive metallic oxide particles are preferable. The conductive particles may be used in mixture of two or more types.

In addition, the conductive particles may be used after being surface-treated with a hydrophobizing agent or the like (for example, coupling agent) for adjusting the resistance.

The content of the conductive particles is preferably 10% by weight to 80% by weight, and more preferably 40% by weight to 80% by weight with respect to the binder resin.

The thickness of the undercoat layer is preferably 15 μm or greater, and more preferably from 20 μm to 50 μm.

The formation of the undercoat layer is not particularly limited, and a well-known formation method is used. For example, the undercoat layer is formed by forming a coating film of an undercoat layer-forming coating solution obtained by adding the above-described components to a solvent; and drying (optionally, heating) the coating solution.

Examples of the method of coating the conductive substrate with the coating liquid for undercoat layer formation include a dipping coating method, an extrusion coating method, a wire bar coating method, a spray coating method, a blade coating method, a knife coating method, and a curtain coating method.

As a method of dispersing the particles in the coating liquid for undercoat layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

Here, although omitted in the drawings, an organic intermediate layer may be further provided between the undercoat layer and the photosensitive layer. Examples of the binder resins for use in the organic intermediate layer include polymeric resin compounds e.g., acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organometallic compounds containing zirconium, titanium, aluminum, manganese, and silicon atoms. These compounds may be used singly or as a mixture or polycondensate of the plural compounds. Among them, an organometallic compound containing zirconium or silicon is preferable because it has a low residual potential, and thus a change in potential due to the environment is small, and a change in potential due to the repeated use is small.

The organic intermediate layer improves the coating property of the upper layer and also functions as an electric blocking layer. However, when the thickness is excessively large, an electric barrier becomes excessively strong, which may cause desensitization or an increase in potential due to the repeated use. Accordingly, when an organic intermediate layer is formed, the thickness may be set to from 0.1 μm to 3 μm. In this case, the organic intermediate layer maybe used as the undercoat layer.

The formation of the organic intermediate layer is not particularly limited, and a well-known formation method is used. For example, the organic intermediate layer is formed by forming a coating film of an organic intermediate layer-forming coating solution obtained by adding the above-described components to a solvent; and drying (optionally, heating) the coating solution.

As a coating method for forming the organic intermediate layer, a general method is used such as a dipping coating method, an extrusion coating method, a wire bar coating method, a spray coating method, a blade coating method, a knife coating method, or a curtain coating method.

Charge Generation Layer

The charge generation layer includes, for example, a charge generation material and a binder resin. Also the charge generation layer includes a vapor deposition film of a charge generation material.

Examples of the charge generation material include phthalocyanine pigments such as metal-free phthalocyanine, chlorogallium phthalocyanine, hydroxygallium phthalocyanine, dichlorotin phthalocyanine, and titanyl phthalocyanine. Particularly, there are exemplified a chlorogallium phthalocyanine crystal having strong diffraction peaks at least at Bragg angles (2θ±0.2°) of 7.4°, 16.6°, 25.5°, and 28.3° with respect to CuKα characteristic X-ray, a metal-free phthalocyanine crystal having strong diffraction peaks at least at Bragg angles (2θ±0.2°) of 7.7°, 9.3°, 16.9°, 17.5°, 22.4°, and 28.8° with respect to CuKα characteristic X-ray, a hydroxygallium phthalocyanine crystal having strong diffraction peaks at least at Bragg angles (2θ±0.2°) of 7.5°, 9.9°, 12.5°, 16.3°, 18.6°, 25.1°, and 28.3° with respect to CuKα characteristic X-ray, and a titanyl phthalocyanine crystal having strong diffraction peaks at least at Bragg angles (2θ±0.2°) of 9.6°, 24.1°, and 27.2° with respect to CuKα characteristic X-ray. Other examples of the charge generation material include quinone pigments, perylene pigments, indigo pigments, bisbenzimidazole pigments, anthrone pigments, and quinacridone pigments. These charge generation materials may be used singly or in mixture of two or more types.

Examples of the binder resin constituting the charge generation layer include a polycarbonate resins such as bisphenol-A type and bisphenol-Z type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used singly or in mixture of two or more types.

The blending ratio of the charge generation material to the binder resin is, for example, preferably from 10:1 to 1:10.

The thickness of the charge generation layer is preferably set to from 0.01 μm to 5 μm, and more preferably from 0.05 μm to 2.0 μm.

The formation of the charge generation layer is not particularly limited, and a well-known formation method is used. For example, the charge generation layer is formed by forming a coating film of a charge generation layer-forming coating solution obtained by adding the above-described components to a solvent; and drying (optionally, heating) the coating solution. The charge generation layer may be formed by vapor deposition of the charge generation material.

Examples of the method of coating the undercoat layer (or the intermediate layer) with the coating liquid for charge generation layer formation include a dipping coating method, an extrusion coating method, a wire bar coating method, a spray coating method, a blade coating method, a knife coating method, and a curtain coating method.

As a method of dispersing the particles (for example, charge generation material) in the coating liquid for charge generation layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

Charge Transport Layer

The charge transport layer includes a charge transport material, and if necessary, a binder resin.

Examples of the charge-transporting organic material include well-known materials, and a p-type charge-transporting organic material or an n-type charge-transporting organic material is selected according to the conductivity type of the inorganic protective layer. However, a p-type charge transporting organic material is preferable (that is, it is preferable that the conductivity type of the inorganic protective layer be n-type or i-type) from the viewpoint of charge transporting properties, availability, and the like.

Examples of the p-type charge transport material (hole transport materials) include e.g., oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylamino styryl)pyrazoline, aromatic tertiary amino compounds such as triphenylamine, trip-methyl)phenylamine, N,N'-bis(3,4-dimethylphenyl)biphenyl-4-amine, 9,9-dimethyl-N,N-di(p-tolyl)fuorenone-2-amine, tris[4-(4,4-diphenyl-1,3-butadienyl)phenyl]amine, tri(p-methylphenyl)aminyl-4-amine, and dibenzylaniline, aromatic tertiary diamino compounds such as N,N'-diphenyl-N,N'-bis(3-methylphenyl)-[1,1-biphenyl]-4,4'-diamine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-ethyl-3-[(2-methyl-1-indolinylimino)methyl]carbazole, 4-(2-methyl-1-indolinyliminomethyl)triphenylamine, 9-methyl-3-carbazolediphenylhydrazone, 1,1-di-(4,4'-methoxyphenyl) acrylaldehydediphenylhydrazone, β,β-bis(methoxyphenyl) vinyldiphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, poly-N-vinylcarbazole and derivatives thereof; and polymers having a group composed of the above-described compounds as a main chain or side chain thereof.

These charge transport materials may be used singly or in combination of two or more types.

Examples of the n-type charge-transporting organic material (for example, electron-transporting organic material) include electron-transporting materials such as quinone compounds such as chloranil and bromoanthraquinone, tetracyanoquinodimethane compounds, fluorenone compounds such as 2,4,7-trinitrofluorenone and 2,4,5,7-tetranitro-9-fluorenone), xanthone compounds, and thiophene compounds; polymers having a group composed of the above-described compounds at the main chain or a side chain thereof.

These charge-transporting organic materials may be used alone or in a combination of two or more kinds.

Examples of the binder resin constituting the charge transport layer include insulating resins e.g., polycarbonate resins such as a bisphenol-A type and a bisphenol-Z type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorinated rubbers; and organic photoconductive polymers such as polyvinyl carbazole, polyvinyl anthracene, and polyvinyl pyrene. These binder resins may be used singly or in mixture of two or more types.

The blending ratio of the charge transport material to the binder resin is, for example, preferably from 10:1 to 1:5.

The thickness of the charge transport layer is preferably set to from 5 μm to 50 μm, and more preferably from 10 μm to 40 μm.

The formation of the charge transport layer is not particularly limited, and a well-known formation method is used. For example, the charge transport layer is formed by forming a coating film of a charge transport layer-forming coating solution obtained by adding the above-described components to a solvent; and drying (optionally, heating) the coating solution.

As a method of coating the charge generation layer with the coating liquid for charge transport layer formation, a general method is used such as a dipping coating method, an extrusion coating method, a wire bar coating method, a spray coating method, a blade coating method, a knife coating method, or a curtain coating method.

As a method of dispersing the particles (for example, fluorine resin particles) in the coating liquid for charge transport layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

Inorganic Protective Layer

The inorganic protective layer includes the interfacial layer, the intermediate layer, and the outermost layer in this order from the organic photosensitive layer side and satisfies the relationship of the following expression (1) (preferably, the relationship of the following expression (1-2)).

$$\rho 3 \leq \rho 1 < \rho 2 \qquad \text{Expression (1):}$$

$$\rho 3 < \rho 1 < \rho 2 \qquad \text{Expression (1-2):}$$

In the expressions (1) and (1-2), 92 1 represents a volume resistivity (Ω·cm) of the interfacial layer, ρ2 represents a volume resistivity (Ω·cm) of the intermediate layer, and ρ3 represents a volume resistivity (Ω·cm) of the outermost layer.

The intermediate layer may include plural layers having different volume resistivities. In this case, the volume resistivity of the intermediate layer represents the total volume resistivity of the plural layers.

The volume resistivity ρ1 of the interfacial layer is, for example, preferably greater than $10^9$ Ω·cm, more preferably from $5\times10^9$ Ω·cm to $5\times10^{10}$ Ω·cm, and still more preferably from $1\times10^{10}$ Ω·cm to $3\times10^{10}$ Ω·cm.

When the volume resistivity ρ1 of the interfacial layer is in the above-described range, image blurring is easily suppressed.

The volume resistivity ρ2 of the intermediate layer is, for example, preferably greater than or equal to $3\times10^{10}$ Ω·cm and more preferably greater than or equal to $4\times10^{10}$ Ω·cm.

When the volume resistivity ρ2 of the intermediate layer is in the above-described range, a residual potential is easily suppressed.

The volume resistivity ρ3 of the outermost layer is, for example, preferably from $5\times10^8$ Ω·cm to $3\times10^{10}$ Ω·cm and more preferably from $1\times10^9$ Ω·cm to $1\times10^{10}$ Ω·cm.

When the volume resistivity ρ3 of the outermost layer is in the above-described range, the charge injecting properties of the inorganic protective layer is improved and a residual potential is easily suppressed.

It is preferable that the ratio ρ2/ρ1 (relative value) of the volume resistivity ρ2 of the intermediate layer to the volume resistivity ρ1 of the interfacial layer be greater than or equal to 2.

When the difference (absolute value) is in the above-described range, image blurring and a residual potential are easily suppressed.

The volume resistivity of each layer included in the inorganic protective layer is controlled by the composition ratio of an inorganic material (deviation from the stoichiometric ratio of compounds), defects of added impurity elements (dopants) and the like, the crystalline structure, and the like. Generally, the n-type conductivity is obtained by introducing oxygen defects in the case of a metal oxide containing an element belonging to Group 12 or 13 and by introducing nitrogen defects in the case of a metal nitride containing an element belonging to Group 12 or 13. In addition, as described below, hydrogen may be introduced to adjust a resistance.

The volume resistivity of each layer of the inorganic protective layer is obtained from a resistance value, measured using an LCR meter ZM2371 (manufactured by NF Corporation) in a measurement environment of 23° C. and 55% RH under conditions of a frequency of 1 kHz and a voltage 1 V, based on an electrode area S and a sample thickness d.

Specifically, the volume resistivity ρv [Ω·cm] is obtained based on the following expression from an AC resistance value Rac [Ω] measured using an LCR meter ZM2371 (manufactured by NF Corporation).

Expression: $\rho v = Rac \times S/d$

A measurement sample may be obtained with a method in which a film is formed on an aluminum substrate under the same conditions as those of the formation of each layer of the inorganic protective layer, which is a measurement target, and a gold electrode is formed on the film by vapor deposition; or may be obtained with a method in which each layer of the inorganic protective layer is peeled off from a prepared electrophotographic photoreceptor, a part of the layer is etched, and the etched part is interposed between a pair of electrodes.

Composition of Inorganic Protective Layer

The inorganic protective layer (interfacial layer, intermediate layer, and outermost layer) contains an inorganic material.

The composition of the interfacial layer, the intermediate layer, and the outermost layer is not particularly limited as long as the volume resistivities thereof are different. For example, all the layers may be formed of the same inorganic material with different composition ratios; or may be formed inorganic materials in which the composition of at least one layer is different from that of the other layers.

Examples of the inorganic material include well-known materials, and a p-type charge-transporting inorganic material or an n-type or i-type charge-transporting inorganic material is selected according to the conductivity type of the organic photosensitive layer (charge transport layer). However, an n-type or i-type charge transporting inorganic material is preferable (that is, it is preferable that the conductivity type of the organic photosensitive layer (charge transport layer) be p-type) from the viewpoint of charge transporting properties, availability, and the like.

The conductivity type of the inorganic material is controlled by the crystalline structure thereof, the doping of each conductivity type dopant, and the like.

Examples of the inorganic material include oxide-based, nitride-based, carbon-based, and silicon-based inorganic materials, from the viewpoints of the mechanical strength and light permeability as the protective layer.

Examples of the oxide-based inorganic materials include metal oxides such as gallium oxide, aluminum oxide, zinc oxide, titanium oxide, indium oxide, tin oxide, and boron oxide; and mixed crystals thereof.

Examples of the nitride-based inorganic materials include metal nitrides such as gallium nitride, aluminum nitride, zinc nitride, titanium nitride, indium nitride, tin nitride, and boron nitride; and mixed crystals thereof.

Examples of the carbon-based and silicon-based inorganic materials include diamond-like carbon (DLC), amorphous carbon (a-C), hydrogenated amorphous carbon (a-C:H), hydrogenated and fluorinated amorphous carbon (a-C:H), amorphous silicon carbide (a-SiC), and hydrogenated amorphous silicon carbide (a-SiC:H).

As the inorganic materials, mixed crystals of the oxide-based and nitride-based inorganic materials may also be used.

Among these, metal oxides are preferable as the inorganic material from the viewpoints of mechanical strength and translucency, in particular, of obtaining n-type conductivity and superior conductivity controllability thereof. In particular, an oxide containing an element belonging to Group 13 (preferably, gallium oxide) is preferable from the viewpoint of chemical stability.

That is, it is preferable that the inorganic protective layer contain at least an element belonging to Group 13 (in particular, gallium) and oxygen, and optionally may further contain hydrogen. By adding hydrogen thereto, the respective physical properties of the inorganic protective layer, which contains an element belonging to Group 13 (in particular, gallium) and oxygen, are easily controlled. For example, in an inorganic protective layer which contains gallium, oxygen, and hydrogen (in an inorganic protective layer which contains gallium oxide containing hydrogen), the volume resistivity is easily controlled in a range of from $10^9$ Ω·cm to $10^{14}$ Ω·cm by changing the composition ratio [O]/[Ga] in a range of from 1.0 to 1.5.

In order to control conductivity type, the inorganic protective layer may further include an impurity element in addition to the above-described inorganic material. For example, when a material such as a nitride or oxide containing an element belonging to Group 13 is set to n-type, the inorganic protective layer may further contain at least one element selected from C, Si, Ge, and Sn. In addition, for example, when a material containing an element belonging to Group 13 is set to p-type, the inorganic protective layer may further contain at least one element selected from N, Be, Mg, Ca, and Sr.

When the inorganic protective layer (each layer) contains at least gallium and oxygen and optionally further contain hydrogen, it is preferable that the inorganic protective layer satisfy the relationship of the following expression (2) (preferably, the relationship of the following expression (2-2)), from the viewpoint of easily satisfying the relationship of the expression (1).

$$C3 \leq C1 < C2 \quad \text{Expression (2):}$$

$$C3 < C1 < C2 \quad \text{Expression (2-2):}$$

In the expressions (2) and (2-2), C1 represents a ratio (oxygen/gallium) of the number of oxygen atoms to the number of gallium atoms in the interfacial layer, C2 represents a ratio (oxygen/gallium) of the number of oxygen atoms to the number of gallium atoms in the intermediate layer, and C3 represents a ratio (oxygen/gallium) of the number of oxygen atoms to the number of gallium atoms in the outermost layer.

The ratio (oxygen/gallium) of the number of oxygen atoms to the number of gallium atoms in the interfacial layer is, for example, preferably from 1.1 to 1.5 and more preferably from 1.2 to 1.4.

The elemental component ratio of hydrogen in the interfacial layer is, for example, preferably from 1 at % to 30 at %, more preferably from 5 at % to 25 at %, and still more preferably from 10 at % to 20 at %, with respect to all the elemental components of the interfacial layer.

The ratio (oxygen/gallium) of the number of oxygen atoms to the number of gallium atoms in the intermediate layer is, for example, preferably from 1.4 to 1.6 and more preferably from 1.45 to 1.55.

The elemental component ratio of hydrogen in the intermediate layer is, for example, preferably from 1 at % to 30 at %, more preferably from 5 at % to 25 at %, and still more preferably from 10 at % to 20 at %, with respect to all the elemental components of the intermediate layer.

The ratio (oxygen/gallium) of the number of oxygen atoms to the number of gallium atoms in the outermost layer is, for example, preferably from 1.0 to 1.4 and more preferably from 1.1 to 1.3.

The elemental component ratio of hydrogen in the outermost layer is, for example, preferably from 1 at % to 30 at %, more preferably from 5 at % to 25 at %, and still more preferably from 10 at % to 20 at %, with respect to all the elemental components of the outermost layer.

In the interfacial layer, the intermediate layer, and the outermost layer, the total elemental component ratio of gallium, oxygen, and hydrogen in each layer is preferably greater than or equal to 85 at % and more preferably greater than or equal to 90 at % with respect to all the elemental components of each layer.

When the total elemental component ratio of gallium, oxygen, and hydrogen in each layer is in the above-described range; and the ratio of the number of oxygen atoms to the number of gallium atoms in each layer is in the above-described range, a resistance is easily controlled.

Specifically, preferable layer configurations for the inorganic protective layer are as follows:

1) A configuration in which all of the interfacial layer, the intermediate layer, and the outermost layer contain at least gallium and oxygen and optionally further contain hydrogen;

2) A configuration in which both the interfacial layer and the intermediate layer contain at least gallium and oxygen and optionally further contain hydrogen, and the outermost layer contains gallium, zinc, and oxygen; and 3) A configuration in which both the intermediate layer and the outermost layer contain at least gallium and oxygen and optionally further contain hydrogen, and the interfacial layer contains gallium, zinc, and oxygen.

The elemental component ratio, ratio of the number of atoms, and the like of each element in each layer of the inorganic protective layer are obtained by Rutherford backscattering spectrometry (hereinafter, referred to as "RBS") including the distribution in the thickness direction.

In RBS, 3SDH Pelletron (manufactured by NEC Corporation) is used as an accelerator; RBS-400 (manufactured by CE&A Co., Ltd.) is used as an end station; and 3S-R10 is used as a system. A program HYPRA (manufactured by CE&A Co., Ltd.) is used for analysis.

Measurement conditions for RBS are as follows: a He++ ion beam energy of 2.275 eV; a detection angle of 160°; and a grazing angle with respect to incident beams of about 109°.

Specifically, the RBS measurement is performed as follows.

First, He++ ion beams are vertically incident on a sample; a detector is set to 160° with respect to the ion beams; and backscattered He signals are measured. The composition ratio and layer thickness are determined from the detected energy and intensity of He. In order to improve the precision of the obtained composition ratio and layer thickness, a spectrum may be measured at two detection angles. The precision is improved by performing the measurement at two detection angles having different resolutions in the depth direction and backscattering mechanical properties; and cross-checking values thereof.

The number of He atoms which are backscattered by a target atom is determined by only three elements including 1) the atomic number of the target atom; 2) the energy of He atoms before scattering; and 3) the scattering angle.

The density is assumed by calculation from a measured composition, and the thickness is calculated using the assumed density. The error range of the density is within 20%.

The elemental component ratio of hydrogen is obtained by Hydrogen forward scattering spectrometry (hereinafter, referred to as "HFS").

In HFS measurement, 3SDH Pelletron (manufactured by NEC Corporation) is used as an accelerator; RBS-400 (manufactured by CE&A Co., Ltd.) is used as an end station; and 3S-R10 is used as a system. A program HYPRA (manufactured by CE&A Co., Ltd.) is used for analysis. Measurement conditions for HFS are as follows: a He++ ion beam energy of 2.275 eV; a detection angle of 160°; and a grazing angle with respect to incident beams of 30°.

In HFS measurement, a detector is set to 30° C. with respect to He++ ion beams; and a sample is set to form 75° C. with the normal line to pick up forward-scattered hydrogen signals of the sample. At this time, it is preferable that the detector be covered with aluminum foil to remove He atoms which are scattered along with hydrogen. For quantification, the amounts of hydrogen of a reference sample and a measurement sample are normalized with stopping power; and values thereof are compared to each other. As the reference sample, a sample obtained by ion-implanting H into Si and muscovite are used.

Muscovite is known to have a hydrogen concentration of 6.5 atom %.

The amount of H adsorbed onto the outermost surface is corrected by subtracting the amount of H adsorbed onto a clean Si surface therefrom.

Characteristics of Inorganic Protective Layer

It is preferable that each layer of the inorganic protective layer be a non-single crystalline film such as a microcrystalline film, a polycrystalline film, or an amorphous film. Among these, an amorphous film is particularly preferable from the viewpoint of smoothness of a surface thereof; and a microcrystalline film is preferable from the viewpoint of hardness.

A growth cross-section of the inorganic protective layer may have a columnar structure, but a high-flatness structure or an amorphous structure is preferable from the viewpoint of sliding property.

Whether the inorganic protective layer is crystalline or amorphous is identified based on whether or not there are points and lines in a diffraction image obtained by reflection high-energy electron diffraction (RHEED).

The elastic modulus of each layer of the inorganic protective layer is preferably from 50 GPa to 150 GPa and more preferably from 60 GPa to 120 GPa.

When this elastic modulus is in the above-described range, concave portions (dent scratches), peeling, and cracking are easily suppressed in the inorganic protective layer.

The elastic modulus is obtained with a method in which a depth profile is obtained using NANO INDENTOR SA2 (manufactured by MTS Systems Corporation) according to continuous stiffness measurement (CSM; U.S. Pat. No. 4,848,141); and the average of measured values at an indentation depth of 30 nm to 100 nm is obtained. Measurement conditions are as follows.

Measurement environment: 23° C., 55% RH
Indenter: Diamond triangular indenter (Berkovich indenter)
Test mode: CSM mode A measurement sample may be obtained with a method in which a film is formed on a substrate under the same conditions as those of the formation of the inorganic protective layer which is a measurement target; or may be obtained with a method in which each layer is peeled off from a prepared electrophotographic photoreceptor and a part of the layer is etched.

The thickness of the inorganic protective layer is, for example, preferably from 0.2 μm to 10.0 μm and more preferably from 0.4 μm to 5.0 μm. When the thickness is in the above-described range, concave portions (dent scratches), peeling, and cracking are easily suppressed in the inorganic protective layer.

The thickness of the interfacial layer is, for example, preferably from 0.05 μm to 1.0 μm. In particular, from the viewpoint of easily suppressing image blurring and a residual potential, the thickness is preferably greater than 0.1 μm and less than or equal to 0.4 μm and more preferably from 0.15 μm to 0.3 μm.

The thickness of the intermediate layer is, for example, preferably from 0.05 μm to 4.5 μm. In particular, from the viewpoint of easily suppressing image blurring and a residual potential, the thickness is preferably from 0.1 μm to 4.0 μm.

The thickness of the outermost layer is, for example, preferably from 0.05 μm to 2.0 μm. In particular, from the viewpoint of suppressing abrasion and a residual potential, the thickness is preferably from 0.2 μm to 1.5 μm and more preferably from 0.5 μm to 1.0 μm.

Formation of Inorganic Protective Layer

For formation of each layer of the inorganic protective layer (hereinafter, simply referred to as "formation of the inorganic protective layer"), for example, a well-known vapor deposition method such as plasma chemical vapor deposition (CVD), organometallic vapor phase epitaxy, molecular beam epitaxy, vapor deposition, or sputtering is used.

Hereinafter, the formation of the inorganic protective layer will be described using a specific example while illustrating an example of a film forming device in the drawings. In the following description, a formation method of each layer of the inorganic protective layer which contains gallium, oxygen, and hydrogen will be described, but the formation method is not limited thereto. A well-known formation method may be adopted according to the composition of a desired inorganic protective layer.

Figure 4A:
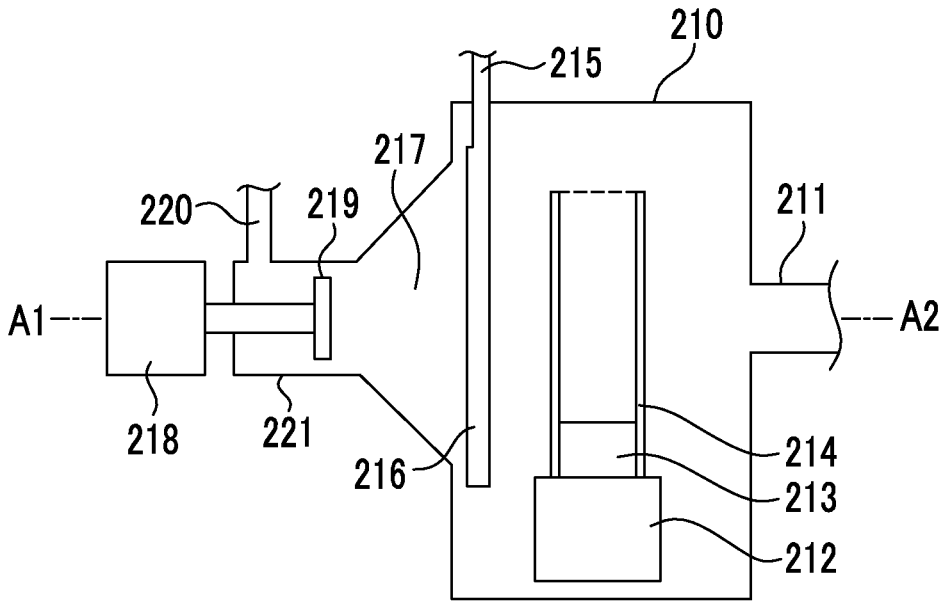
FIGS. 4A and 4B are diagrams schematically illustrating an example of a film forming device which is used for forming an inorganic protective layer of the electrophotographic photoreceptor according to the exemplary embodiment.
Figure 4B:
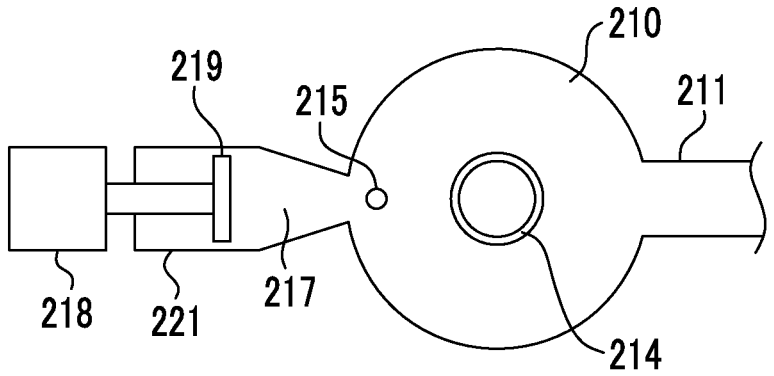

FIGS. 4A and 4B are diagrams schematically illustrating an example of a film forming device which is used for forming an inorganic protective layer of the electrophotographic photoreceptor according to the exemplary embodiment. FIG. 4A is a cross-sectional view schematically illustrating the film forming device when seen from a side, and FIG. 4B is a cross-sectional view taken along line A1-A2 schematically illustrating the film forming device illustrated in FIG. 4A. In FIGS. 4A and 4B, reference numeral 210 represents a film forming chamber; reference numeral 211 represents an exhaust port; reference numeral 212 represents a substrate rotating portion; reference numeral 213 represents a substrate support member; reference numeral 214 represents a substrate; reference numeral 215 represents a gas introduction tube; reference numeral 216 represents a shower nozzle having an opening which discharges gas introduced from the gas introduction tube 215; reference numeral 217 represents a plasma diffusion portion; reference numeral 218 represents a high-frequency power supply; reference numeral 219 represents a plate electrode; reference numeral 220 represents a gas introduction tube; and reference numeral 221 represents a high-frequency discharge tube.

In the film forming device illustrated in FIGS. 4A and 4B, the exhaust port 211 that is connected to a vacuum pump (not illustrated) is provided at an end of the film forming chamber 210; and a plasma generating device including the high-frequency power supply 218, the plate electrode 219, and the high-frequency discharge tube 221 is provided on the opposite side of the film forming chamber 210 to the side where the exhaust port 211 is provided.

This plasma generating device includes the high-frequency discharge tube 221; the plate electrode 219 that is arranged inside the high-frequency discharge tube 221 and has a discharge surface provided on the side of the exhaust port 211; and the high-frequency power supply 218 that is arranged outside the high-frequency discharge tube 221 and is connected to the opposite surface to the discharge surface of the plate electrode 219. The high-frequency discharge tube 221 is connected to one end of a gas introduction tube 220 for supplying gas into the high-frequency discharge tube 221; and a first gas supply source (not illustrated) is connected to the other end of the gas introduction tube 220.

Figure 5:
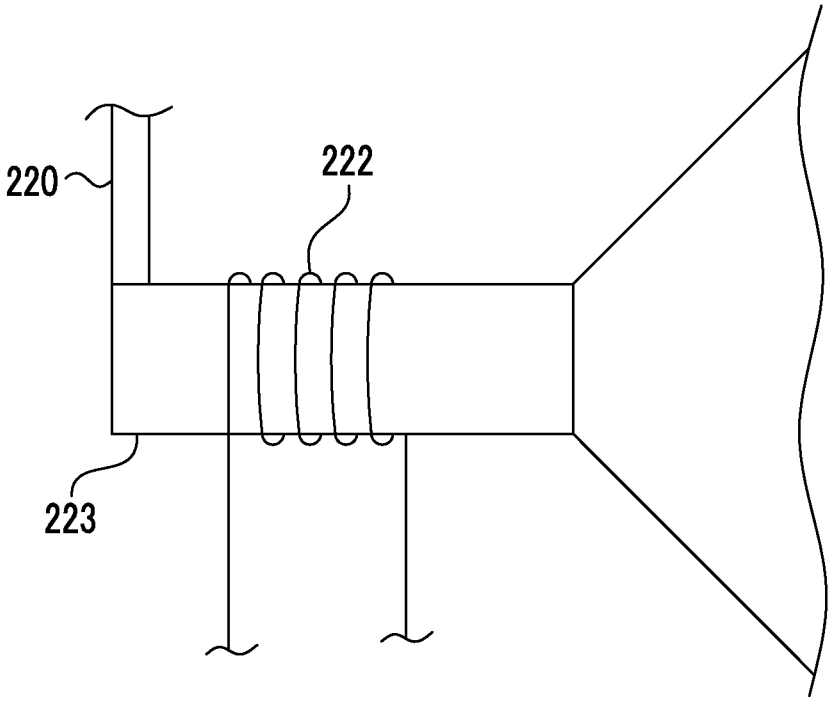
FIG. 5 is a diagram schematically illustrating an example of a plasma generating device which is used for forming the inorganic protective layer of the electrophotographic photoreceptor according to the exemplary embodiment.

A plasma generating device illustrated in FIG. 5 may be used instead of the plasma generating device which is provided in the film forming device illustrated in FIGS. 4A and 413. FIG. 5 is a diagram schematically illustrating another example of a plasma generating device which is used in the film forming device illustrated in FIGS. 4A and 4B; and is a side view of the plasma generating device. In FIG. 5, reference numeral 222 represents a high-frequency coil; reference numeral 223 represents a quartz tube; and reference numeral 220 represents the same component as that of FIGS. 4A and 413. This plasma generating device includes the quartz tube 223 and the high-frequency coil 222 that is provided on an outer peripheral surface of the quartz tube 223. The film forming chamber 210 (not illustrated in FIG. 5) is connected to one end of the quartz tube 223. In addition, the gas introduction tube 220 for supplying gas into the quartz tube 223 is connected to the other end of the quartz tube 223.

In FIGS. 4A and 4B, the rod-like shower nozzle 216 that extends along the discharge surface is connected to the discharge surface side of the plate electrode 219; the gas introduction tube 215 is connected to one end of the shower nozzle 216; and this gas introduction tube 215 is connected to a second gas supply source (not illustrated) that is provided outside the film forming chamber 210.

In addition, in the film forming chamber 210, the substrate rotating portion 212 is provided; and the cylindrical substrate 214 is attached to the substrate rotating portion 212 through the substrate support member 213 such that a longitudinal direction of the shower nozzle 216 and an axial direction of the substrate 214 face to each other in parallel. When a film is formed, the substrate rotating portion 212 rotates to rotate the substrate 214 in a circumferential direction thereof. As the substrate 214, a photoreceptor in which layers are laminated up to the organic photosensitive layer in advance or the like is used.

The inorganic protective layer is formed, for example, as follows.

In addition, oxygen gas (or helium (He)-diluted oxygen gas), helium (He) gas, and optionally hydrogen ($H_2$) gas are introduced from the gas introduction tube 220 to the high-frequency discharge tube 221 while supplying 13.56 MHz radio waves from the high-frequency power supply 218 to the plate electrode 219. At this time, the plasma diffusion portion 217 is formed so as to radially spread from the discharge surface side of the plate electrode 219 toward the exhaust port 211 side. Gas, introduced from the gas introduction tube 220, flows through the film forming chamber 210 from the plate electrode 219 side toward the exhaust port 211 side. The plate electrode 219 may be surrounded by a ground shield.

Next, trimethylgallium gas is introduced into the film forming chamber 210 through the gas introduction tube 215 and the shower nozzle 216 that is located downstream of the plate electrode 219 which is an activation unit. As a result, a non-single crystalline film containing gallium, oxygen, and hydrogen is formed on a surface of the substrate 214.

As the substrate 214, for example, a substrate on which the organic photosensitive layer is formed is used.

When the inorganic protective layer is formed, the surface temperature of the substrate 214 is preferably lower than or equal to 150° C., more preferably lower than or equal to 100° C., and still more preferably from 30° C. to 100° C. because an organic photoreceptor having the organic photosensitive layer is used.

Even when the surface temperature of the substrate 214 is lower than or equal to 150° C. in the initial stage of the film formation, the surface temperature may become higher than 150° C. due to effects of plasma and thus the organic photosensitive layer may be damaged by heat. Therefore, it is preferable that the surface temperature of the substrate 214 be controlled in consideration of the effects.

The surface temperature of the substrate 214 may be controlled by a heating and/or cooling unit (not illustrated); or may be naturally increased during an electric discharge. When the substrate 214 is heated, a heater may be provided inside or outside the substrate 214. When the substrate 214 is cooled, gas or liquid for cooling may be circulated inside the substrate 214.

When it is desired to avoid an increase in the surface temperature of the substrate 214 caused by an electric discharge, it is effective to adjust high-energy gas flow in contact with the surface of the substrate 214. In this case, conditions such as a gas flow rate, a discharge power, and a pressure are adjusted so as to obtain a desired temperature.

In addition, instead of trimethylgallium gas, an organometallic compound containing aluminum or a hydride such as diborane may be used; or a mixture of two or more kinds thereof may be used.

For example, in the initial stage of forming the inorganic protective layer, trimethylindium gas is introduced into the film forming chamber 210 through the gas introduction tube 215 and the shower nozzle 216 to form a film containing nitrogen and indium on the substrate 214. In this case, this film absorbs ultraviolet rays that are generated during continuous film formation and impair the organic photosensitive layer. Therefore, the organic photosensitive layer is inhibited from being damaged by ultraviolet rays generated during film formation.

In addition, in a doping method of a dopant during film formation, $SiH_3$ or $SnH_4$ in the gas state is used for an n-type dopant; and bis-cyclopentadienyl magnesium, dimethyl calcium, dimethyl strontium, or the like in the gas state is used for a p-type dopant. In addition, in order to dope the surface layer with a dopant element, a well-known method such as a thermal diffusion method or an ion implantation method may be used.

Specifically, gas which contains, for example, at least one or more dopant elements is introduced into the film forming chamber 210 through the gas introduction tube 215 and the shower nozzle 216 to obtain the inorganic protective layer having conductivity types of n-type, p-type, and the like.

In the film forming device described using FIGS. 4A, 4B, and 5, active nitrogen or active hydrogen generated by discharge energy may be independently controlled by plural activation devices; or gas containing both nitrogen atoms and hydrogen atoms such as $NH_3$ may be used. Furthermore, $H_2$ may be added thereto. In addition, conditions under which active hydrogen is isolated from an organometallic compound may be used.

By doing so, carbon atoms, gallium atoms, nitrogen atoms, hydrogen atoms, and the like, which are activated and controlled, are present on a surface of the substrate 214. Activated hydrogen atoms have an effect of removing hydrogen molecules of a hydrocarbon group such as a methyl group or an ethyl group included in an organometallic compound.

Therefore, a hard film (inorganic protective layer) having a three-dimensional bond is formed.

As a plasma generating unit of the film forming device illustrated in FIGS. 4A, 4B, and 5, a high-frequency oscillator is used, but the plasma generating unit is not limited thereto. For example, a microwave oscillator, an electron cyclotron resonance type device, or a helicon plasma type device may be used. In addition, examples of the high-frequency oscillator include an inductor oscillator or a capacitor oscillator.

Furthermore, two or more types of devices may be used in combination; or two or more devices of the same type may be used. In order to suppress an increase in the surface temperature of the substrate 214 caused by plasma irradiation, a high-frequency oscillator is preferable. A device that suppresses heat radiation may be provided.

When two or more different types of plasma generating devices (plasma generating units) are used, it is preferable that an electric discharge simultaneously occur under the same pressure. In addition, a pressure in a discharge region and a pressure in a film forming region (in which the substrate is installed) may be different from each other. These devices may be arranged in series with gas flow flowing through the inside of the film forming device from a gas introduction portion to a gas discharge portion; or all the devices may be arranged opposite a film forming surface of the substrate.

For example, a case in which two or more types of plasma generating units are arranged in series with gas flow will be described using the film forming device illustrated in FIGS. 4A and 4B as an example. In this case, the shower nozzle 216 is used as an electrode and as a second plasma generating device which causes an electric discharge to occur in the film forming chamber 210. In addition, a high-frequency voltage is applied to the shower nozzle 216 through, for example, the gas introduction tube 215. As a result, an electric discharge occurs in the film forming chamber 210 using the shower nozzle 216 as an electrode. Alternatively, instead of using the shower nozzle 216 as an electrode, a cylindrical electrode is provided between the substrate 214 and the plate electrode 219 in the film forming chamber 210; and this cylindrical electrode causes an electric discharge to occur in the film forming chamber 210.

In addition, a case in which two different types of plasma generating devices are used under the same pressure will be described. For example, when a microwave oscillator and a high-frequency oscillator are used, the excitation energy of excited species may be greatly changed, which is effective for controlling film quality. In addition, an electric discharge may occur under about the atmospheric pressure (from 70,000 Pa to 110,000 Pa). When an electric discharge occurs under about the atmospheric pressure, it is preferable that He be used as a carrier gas.

The inorganic protective layer is formed by providing the substrate 214 on which the organic photosensitive layer is formed in the film forming chamber 210 and introducing mixed gas having different compositions thereinto.

In addition, for example, when a high-frequency discharge is used as film forming conditions, it is preferable that the frequency be in a range of from 10 kHz to 50 MHz in order to form a high-quality film at a low temperature. In addition, although depending on the size of the substrate 214, it is preferable that the power be in a range of from 0.01 $W/cm^2$ to 0.2 $W/cm^2$ with respect to the surface area of the substrate. It is preferable that the rotating speed of the substrate 214 be from 0.1 rpm to 500 rpm.

Each layer of the inorganic protective layer may be continuously formed by introducing mixed gas having different compositions thereinto; and may be independently formed, according to a desired volume resistivity. In addition, the film forming conditions of each layer are selected according to a desired volume resistivity.

As described above, an example of the functional separation-type electrophotographic photoreceptor has been described, however, for example, when the single layer-type photosensitive layer 6 (charge generation/charge transport layer) shown in FIG. 3 is formed, the content of the charge generation material is preferably from about 10% by weight to about 85% by weight, and more preferably from 20% by weight to 50% by weight. In addition, the content of the charge transport material is preferably from 5% by weight to 50% by weight.

A method of forming the single layer-type photosensitive layer 6 is the same as the method of forming the charge generation layer 2 or the charge transport layer 3. The thickness of the single layer-type photosensitive layer 6 is preferably from about 5 μm to about 50 μm, and more preferably from 10 μm to 40 μm.

Image Forming Apparatus, Process Cartridge

Figure 6:
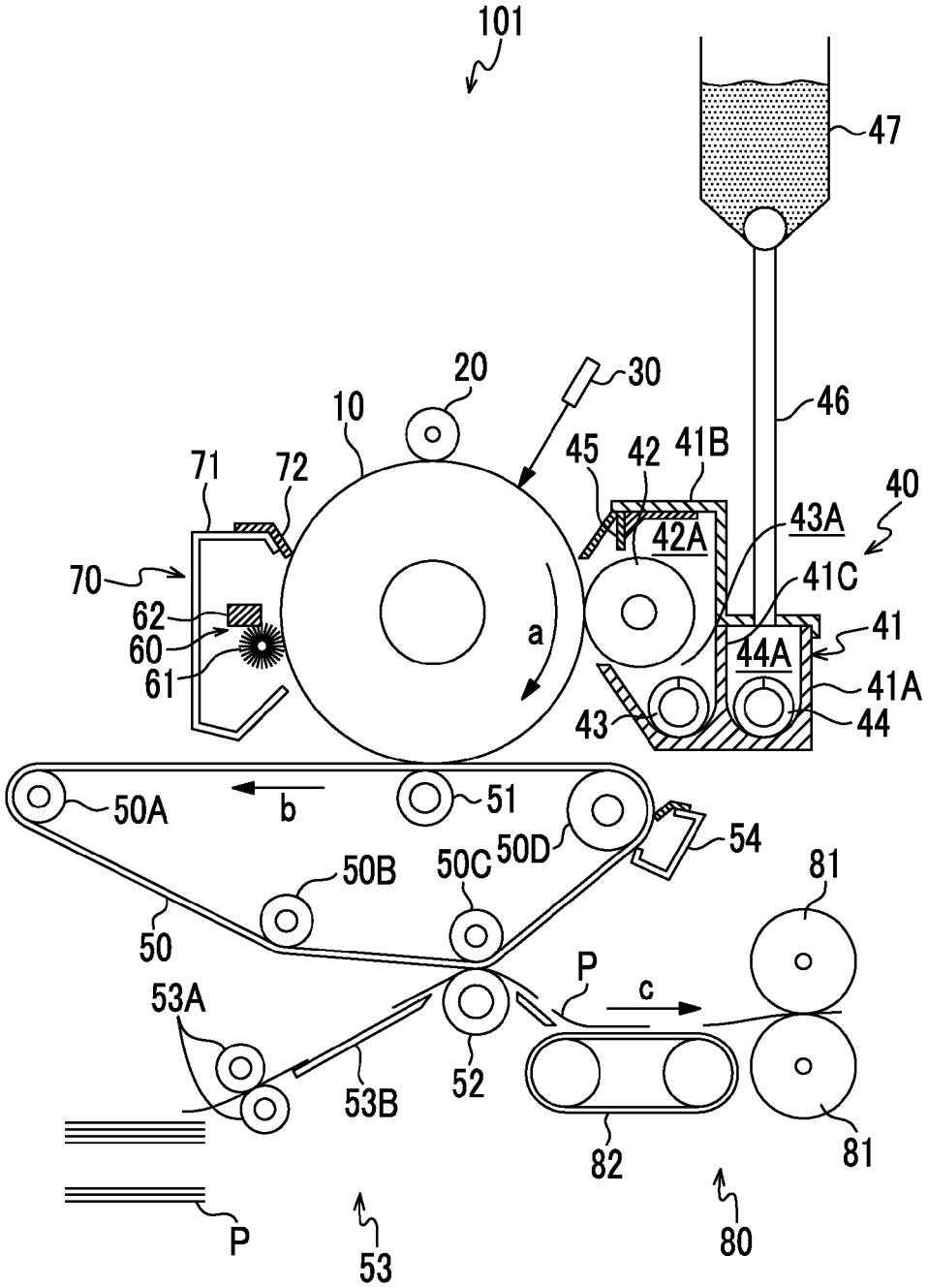
FIG. 6 is a diagram schematically illustrating a configuration example of an image forming apparatus according to an exemplary embodiment of the present invention.

FIG. 6 is a diagram schematically showing the configuration of an image forming apparatus according to this exemplary embodiment.

As shown in FIG. 6, an image forming apparatus 101 according to this exemplary embodiment is provided with, for example, an electrophotographic photoreceptor 10 that rotates in a clockwise direction as shown by the arrow a, a charging device 20 (an example of charging unit) that is provided above the electrophotographic photoreceptor 10 to face the electrophotographic photoreceptor 10 and to charge a surface of the electrophotographic photoreceptor 10, an exposure device 30 (an example of electrostatic latent image forming unit) that exposes the surface of the electrophotographic photoreceptor 10 charged by the charging device 20 to form an electrostatic latent image, a developing device 40 (an example of developing unit) that adheres a toner contained in a developer to the electrostatic latent image formed using the exposure device 30 to form a toner image on the surface of the electrophotographic photoreceptor 10, an intermediate transfer member 50 that contacts with the electrophotographic photoreceptor 10 and moves to the direction b and transfers the toner image on the electrophotographic photoreceptor 10 onto the recording paper, and a cleaning device 70 (an example of toner cleaning unit) that cleans the surface of the electrophotographic photoreceptor 10.

The charging device 20, the exposure device 30, the developing device 40, the intermediate transfer member 50, a lubricant supply device 60, and the cleaning device 70 are arranged clockwise on a circle surrounding the electrophotographic photoreceptor 10. In the exemplary embodiment, the lubricant supply device 60 is arranged inside the cleaning device 70, but the exemplary embodiment is not limited thereto. The lubricant supply device 60 may be arranged separately from the cleaning device 70. In addition, the lubricant supply device is not necessarily provided.

The intermediate transfer member 50 is held from its inside by support rollers 50A and 50B, a rear surface roller 50C and a drive roller 50D while a tension is applied thereto; and is driven in a direction indicated by arrow b along with the rotation of the drive roller 50D. At a position in the intermediate transfer member 50 opposite the electrophotographic photoreceptor 10, a primary transfer device 51 that charges the intermediate transfer member 50 to a different polarity from that of a toner to attract the toner, located on the electrophotographic photoreceptor 10, to an outside surface of the intermediate transfer member 50 is provided. On the lower outside of the intermediate transfer member 50, a secondary transfer device 52 that charges a recording paper P (an example of the recording medium) to a different polarity from that of the toner to transfer a toner image, formed on the intermediate transfer member 50, onto the recording medium P is provided opposite the rear surface roller 50C. These members for transferring the toner image, formed on the electrophotographic photoreceptor 10, onto the recording paper P correspond to an example of the transfer unit.

Below the intermediate transfer member 50, a recording paper supply device 53 that supplies the recording paper P to the secondary transfer device 52; and a fixing device 80 that fixes the toner image, formed by the secondary transfer device 52, on the recording paper P while transporting the recording paper P on which the toner image is formed.

The recording paper supply device 53 includes a pair of transport rollers 53A; and a guide slope 53B that guides the recording paper P, transported by the transport roller 53A, to the secondary transfer device 52. The fixing device 80 includes fixing rollers 81 that are a pair of heat rollers and heat and press the recording paper P, onto which the toner image is transferred by the secondary transfer device 52, to fix the toner image thereon; and a transport conveyor 82 that transports the recording paper P to the fixing roller 81.

The recording paper P is transported in the direction indicated by arrow c by the recording paper supply device 53, the secondary transfer device 52, and the fixing device 80.

In the intermediate transfer member 50, an intermediate transfer member cleaning device 54 that includes a cleaning blade, which removes toner remaining on the intermediate transfer member 50 after the toner image is transferred onto the recording paper P by the secondary transfer device 52, is provided.

Hereinafter, major components of an image forming apparatus 101 according to an exemplary embodiment of the invention will be described in detail.

Charging Device

Examples of the charging device 20 include contact-type charging units using a conductive charging roller, a charging brush, a charging film, a charging rubber blade, a charging tube, and the like. In addition, examples of the charging device 20 also include well-known charging units such as non-contact-type roller charging units, and scorotron charging units and corotron charging units using corona discharge. A contact-type charging unit is preferable as the charging device 20.

Exposure Device

Examples of the exposure device 30 include optical equipment that exposes the surface of the electrophotographic photoreceptor 10 with light such as semiconductor laser light, LED light, or liquid crystal shutter light in the form of an image. The wavelength of a light source is preferably in the spectral sensitivity region of the electrophotographic photoreceptor 10. As for the wavelength of the semiconductor laser, for example, a near-infrared laser having an oscillation wavelength of approximately 780 nm may be preferably used. However, the wavelength is not limited thereto, and a laser having an oscillation wavelength of 600 nm to less than 700 nm or a laser having an oscillation wavelength of 400 nm to 450 nm as a blue laser may also be used. In addition, as the exposure device 30, it is also effective to use a surface-emitting laser light source that outputs multi-beams in order to form a color image for example.

Developing Device

The developing device 40 is arranged in a development region, for example, to face the electrophotographic photoreceptor 10. The developing device 40 includes a developer container (developing device main body) 41 that accommodates, for example, a two-component developer containing a toner and a carrier; and a replenishment developer container (toner cartridge) 47. The developer container 41 includes a developer container main body 41A; and developer container cover 41B that covers an upper end of the developer container main body 41A.

The developer container main body 41A includes, for example, a developing roller chamber 42A that accommodates a developing roller 42; a first agitating chamber 43A that is provided adjacent to the developing roller chamber 42A; and a second agitating chamber 44A that is provided adjacent to the first agitating chamber 43A. In addition, in the developing roller chamber 42A, a layer thickness restricting member 45 that restricts the thickness of a developer layer on the surface of the developing roller 42 is provided, for example, when the developer container cover 41B is mounted to the developer container main body 41A.

The first agitating chamber 43A and the second agitating chamber 44A are partitioned by, for example, a partition wall 41C. Although not shown, the first agitating chamber 43A and the second agitating chamber 44A are connected to each other through openings which are provided at both ends of the partition wall 41C in a longitudinal direction thereof (longitudinal direction of the developing device). The first agitating chamber 43A and the second agitating chamber 44A form a circulation agitating chamber (43A+44A).

In the developing roller chamber 42A, the developing roller 42 is arranged opposite the electrophotographic photoreceptor 10. In the developing roller 42, a sleeve is provided outside a magnetic roller (not illustrated; stationary magnet). A developer in the first agitating chamber 43A is adsorbed onto a surface of the developing roller 42 by a magnetic force of the magnetic roller and is transported to the development region. In addition, a roller shaft of the developing roller 42 is rotatably supported by the developer container main body 41A. The developing roller 42 and the electrophotographic photoreceptor 10 rotate in the same direction. On the opposite side thereto, the developer adsorbed onto the surface of the developing roller 42 is transported to the development region in the opposite direction to the rotating direction of the electrophotographic photoreceptor 10.

In addition, a bias power supply (not illustrated) is connected to the sleeve of the developing roller 42 to apply a developing bias thereto (in the exemplary embodiment, a bias in which a direct current (DC) component and an alternating current (AC) component are superimposed on each other is applied so as to apply an alternating electric filed to the development region).

In the first agitating chamber 43A and the second agitating chamber 44A, a first agitating member 43 (agitating and transporting member) and a second agitating member 44 (agitating and transporting member) that transport the developer while agitating the developer are provided, respectively. The first agitating member 43 includes a first rotating shaft that extends in an axial direction of the developing roller 42; and an agitating and transporting blade (protrusion) that is fixed to an outer circumference of the rotating shaft in a spiral shape. Likewise, the second agitating member 44 also includes a second rotating shaft and an agitating and transporting blade (protrusion). The agitating members are rotatably supported by the developer container main body 41A. The first agitating member 43 and the second agitating member 44 are arranged such that the developer in the first agitating chamber 43A and the second agitating chamber 44A is transported in opposite directions to each other due to their rotation.

One end of a replenishing path 46 that supplies a replenishment developer containing a replenishment toner and a replenishment carrier to the second agitating chamber 44A is connected to one end of the second agitating chamber 44A in the longitudinal direction; and the other end of the replenishing path 46 is connected to a replenishment developer container 47 that accommodates the replenishment developer.

In this way, the replenishment developer is supplied from the replenishment developer container (toner cartridge) 47 to the developing device 40 (the second agitating chamber 44A) through the replenishing path 46.

Examples of the developer used in the developing device 40 include well-known developers such as a single-component developer containing a toner alone and a two-component developer containing a toner and a carrier.

Transfer Device

Examples of the primary transfer device 51 and the secondary transfer device 52 include contact-type transfer charging units using a belt, a roller, a film, a rubber blade, and the like; and well-known transfer charging units such as scorotron transfer units and corotron transfer units using corona discharge.

Examples of the intermediate transfer member 50 include a belt-shaped member (intermediate transfer belt) that contains a conductive agent and is formed of polyimide, polyamidimide, polycarbonate, polyarylate, polyester, or rubber. In addition, the intermediate transfer member may have a cylindrical shape in addition to a belt shape.

Cleaning Device

The cleaning device 70 includes, for example, a housing 71, a cleaning blade 72 projecting from housing and a lubricant supply device 60 arranged at the downstream side of the cleaning blade 72 in the rotation direction of the electrophotographic photoreceptor 10. And the cleaning blade 72 may be supported at the edge portion of the housing 71, or may be supported by holder. This embodiment shows a configuration that the cleaning blade 72 is supported at the edge portion of the housing 71.

First, the cleaning blade 72 will be described.

Examples of a material of the cleaning blade 72 (a cleaning layer 72A and a rear surface layer 72B) include urethane rubber, silicone rubber, fluorine rubber, propylene rubber, and butadiene rubber. Among these, urethane rubber is preferable.

Urethane rubber (polyurethane) is not particularly limited as long as it is generally used for forming polyurethane, and preferable examples thereof include urethane rubbers which are obtained by using, as raw materials, urethane prepolymers composed of a polyol such as a polyester polyol (for example, polyethylene adipate or polycaprolactone) and an isocyanate such as diphenylmethane diisocyanate; and a crosslinking agent such as 1,4-butanediol, trimethylolpropane, ethylene glycol, or a mixture thereof.

Next, the lubricant supply device 60 will be described.

For example, the lubricant supply device 60 is provided inside the cleaning device 70 and upstream of the cleaning blade in the rotating direction of the electrophotographic photoreceptor 10.

For example, the lubricant supply device 60 includes a rotating brush 61 that is arranged in contact with the electrophotographic photoreceptor 10; and a solid lubricant 62 that is arranged in contact with the rotating brush 61. In the lubricant supply device 60, the rotating brush 61 rotates in a state of being in contact with the solid lubricant 62 to attach the lubricant 62 to the rotating brush 61; the attached lubricant 62 is supplied to a surface of the electrophotographic photoreceptor 10 to form a film of the lubricant 62.

The lubricant supply device 60 is not limited to the above-described configuration, and a rubber roller may be used instead of the rotating brush 61, for example.

Operation of the Image Forming Apparatus

Hereinafter, the operation of the image forming apparatus 101 according to this exemplary embodiment will be described. First, when the electrophotographic photoreceptor 10 is rotated in the direction represented by the arrow a, it is negatively charged by the charging device 20 at the same time.

The electrophotographic photoreceptor 10, the surface of which has been negatively charged by the charging device 20, is exposed using the exposure device 30, and a latent image is formed on the surface thereof.

When a part in the electrophotographic photoreceptor 10, in which the latent image has been formed, approaches the developing device 40, the developing device 40 (developing roll 41) adheres a toner to the latent image to form a toner image.

When the electrophotographic photoreceptor 10 on which the toner image is formed rotates in a direction indicated by arrow a, the toner image is transferred onto the outside surface of the intermediate transfer member 50.

Once the toner image is transferred onto the intermediate transfer member 50, the recording paper P is supplied to the secondary transfer device 52 by the recording paper supply device 53. The toner image, transferred onto the intermediate transfer member 50, is transferred onto the recording paper P by the secondary transfer device 52. As a result, the toner image is formed on the recording paper P.

The toner image, formed on the recording paper P, is fixed on the recording paper P by the fixing device 80.

After the toner image is transferred onto the intermediate transfer member 50, the lubricant 62 is supplied to a surface of the electrophotographic photoreceptor 10 by the lubricant supply device 60 to form a film of the lubricant 62 on the surface of the electrophotographic photoreceptor 10. Then, toner and corona products remaining on the surface are removed by the cleaning blade 72 of the cleaning device 70. After the toner image is transferred, the electrophotographic photoreceptor 10, from which the remaining toner and the corona products are removed by the cleaning device 70, is charged again by the charging device 20; and is exposed to light by the exposure device 30 to form a latent image thereon.

Figure 7:
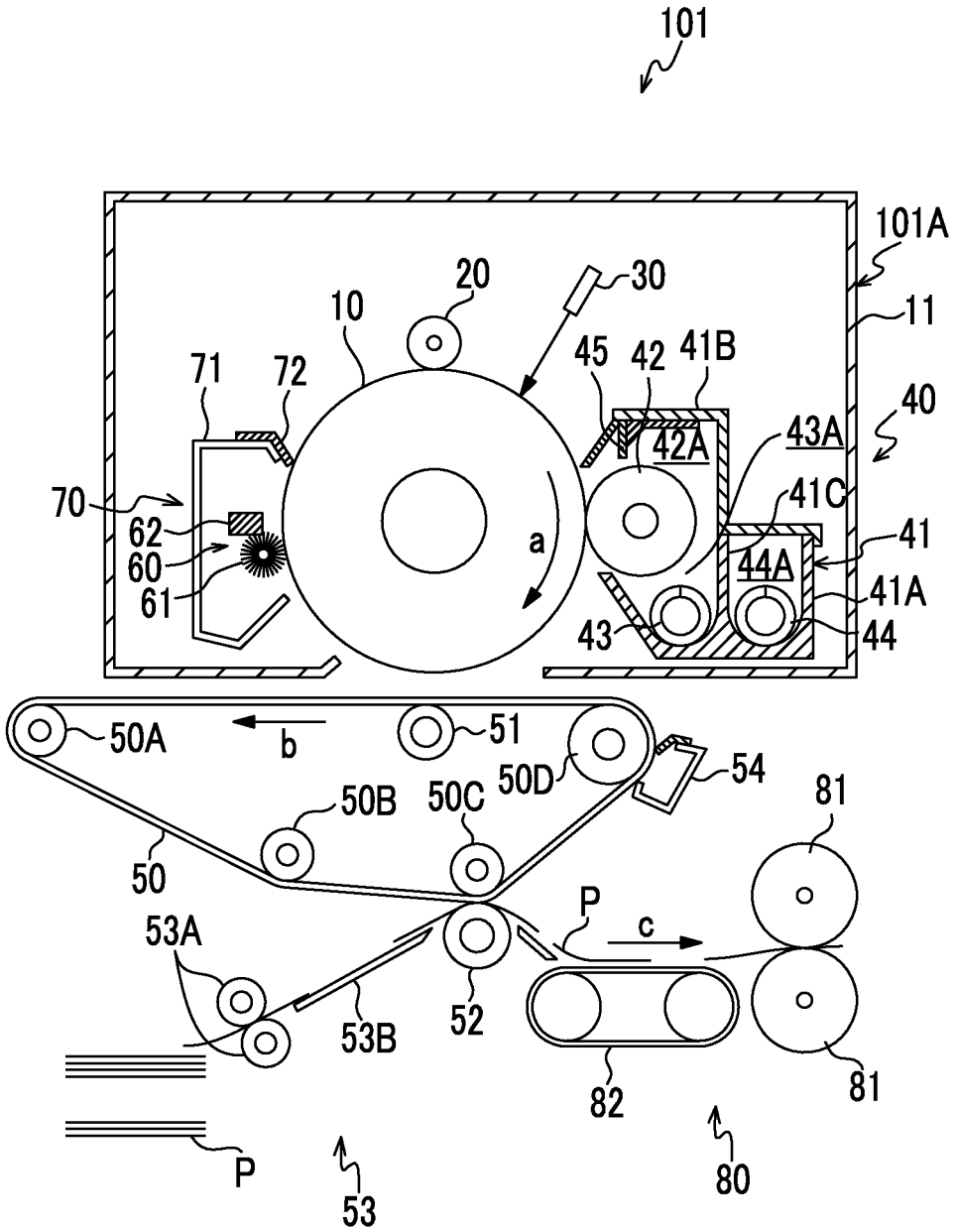
FIG. 7 is a diagram schematically illustrating another configuration example of the image forming apparatus according to the exemplary embodiment.

In addition, as illustrated in FIG. 7, for example, the image forming apparatus 101 according to the exemplary embodiment may include a process cartridge 101A in which the electrophotographic photoreceptor 10, the charging device 20, the developing device 40, the lubricant supply device 60, and the cleaning device 70 are integrally accommodated in a housing 11. This process cartridge 101A integrally accommodates plural members and is detachable from the image forming apparatus 101. In the developing device 40 of the image forming apparatus 101 illustrated in FIG. 7, the replenishment developer container 47 is not provided.

The configuration of the process cartridge 101A is not limited thereto. For example, the process cartridge 101A includes at least the electrophotographic photoreceptor 10 and may further include, for example, at least one selected from the charging device 20, the exposure device 30, the developing device 40, the primary transfer device 51, the lubricant supply device 60, and the cleaning device 70.

In addition, the image forming apparatus 101 according to the exemplary embodiment is not limited to the above-described configurations. For example, a first erasing device for aligning the polarity of remaining toner and facilitating the cleaning brush to remove the remaining toner may be provided downstream of the primary transfer device 51 in the rotating direction of the electrophotographic photoreceptor 10 and upstream of the cleaning device 70 in the rotating direction of the electrophotographic photoreceptor 10 in the vicinity of the electrophotographic photoreceptor 10; or a second erasing device for erasing the charge on the surface of the electrophotographic photoreceptor 10 may be provided downstream of the cleaning device 70 in the rotating direction of the electrophotographic photoreceptor 10 and upstream of the charging device 20 in the rotating direction of the electrophotographic photoreceptor 10.

In addition, the image forming apparatus 101 according to the exemplary embodiment is not limited to the above-described configurations and well-known configurations may be adopted. For example, a configuration in which the toner image, which is formed on the electrophotographic photoreceptor 10, is directly transferred onto the recording paper P may be adopted; or a tandem-type image forming apparatus may be adopted.

EXAMPLES

Hereinafter, the present invention will be described in detail using examples. However, the present invention is not limited to the examples. In the following examples, "part (s)" represents "part (s) by weight".

Example 1

Formation of Undercoat Layer 100 parts by weight of zinc oxide particles (average particle diameter: 70 nm, manufactured by Tayca Corporation) is stirred and mixed with 500 parts by weight of toluene. 1.5 parts by weight of silane coupling agent (trade name: KBM 603, manufactured by Shin-Etsu Chemical Co., Ltd.) is added thereto, followed by stirring for 2 hours. Then, toluene is removed by distillation under reduced pressure, followed by annealing at 150° C. for 2 hours.

60 parts by weight of zinc oxide particles which are surface-treated as above, 15 parts by weight of curing agent (blocked isocyanate, trade name: SUMIDUR BL3175, manufactured by Sumitomo Bayer Urethane Co., Ltd.), and 15 parts by weight of butyral resin (trade name: S-LEC BM-1, manufactured by Sekisui Chemical Co., Ltd.) are dissolved in 85 parts by weight of methyl ethyl ketone to obtain a solution. 38 parts by weight of the solution is mixed with 25 parts by weight of methyl ethyl ketone to obtain a treatment solution.

Next, dispersing is performed in the following procedure using a horizontal media mill disperser (KDL-PILOT type, dyno mill, manufactured by Shinmaru Enterprises Corporation). A cylinder and a stirring mill of the disperser are formed of ceramics containing zirconia as a major component. Glass beads (HIBEA D20, manufactured by Ohara Inc.) having a diameter of 1 mm are put into this cylinder at a volume packing ratio of 80%, followed by dispersing with a circulation method at a peripheral speed of the stirring mill of 8 m/min and a flow rate of the treatment solution of 1,000 mL/min. The treatment solution is transported by a magnetic gear pump.

During dispersing, a part of the treatment solution is sampled after a predetermined time to measure a transmittance during film formation. That is, the treatment solution is coated on a glass plate to have a layer having a thickness of 20 μm, followed by curing at 150° C. for 2 hours. As a result, a coating film is formed. Then, a transmittance at a wavelength of 950 nm is measured using a spectrophotometer (U-2000, manufactured by Hitachi High-Technologies Corporation). Once this transmittance (value at a thickness of 20 nm) is greater than 70%, dispersing is finished.

0.005 parts by weight of dioctyl tin dilaurate as a catalyst and 0.01 parts by weight of silicone oil (trade name: SH29PA, manufactured by Dow Corning Toray Corporation) are added to the dispersion obtained as above. As a result, an undercoat layer-forming coating solution is prepared. This coating solution is dip-coated on an aluminum substrate having a diameter of 30 mm, a length of 410 mm, and a thickness of 1 mm, followed by drying and curing at 160° C. for 100 minutes. As a result, an undercoat layer having a thickness of 20 μm is formed.

Formation of Organic Photosensitive Layer

Next, a photosensitive layer is formed on the undercoat layer.

First, 15 parts by weight of chlorogallium phthalocyanine, as a charge generation material, having diffraction peaks at Bragg angles (2θ±0.2°) of at least 7.4°, 16.6°, 25.5°, and 28.3° in an X-ray diffraction spectrum using CuKα rays; 10 parts by weight of vinyl chloride-vinyl acetate copolymer resin (trade name: VMCH, manufactured by Nippon Unicar Co., Ltd.) as a binder resin; and 300 parts by weight of n-butyl alcohol are mixed with each other to obtain a mixture. This mixture is dispersed for 4 hours using a sand mill with glass beads having a diameter of 1 mm. As a result, a charge generation layer-forming coating solution is obtained. The obtained dispersion is dip-coated on the undercoat layer, followed by drying. As a result, a charge generation layer having a thickness of 0.2 μm is formed.

Furthermore, 4 parts by weight of N,N'-diphenyl-N,N'-bis(3-methylphenyl)-[1,1']biphenyl-4,4'-diamine and 6 parts by weight of bisphenol Z polycarbonate resin (viscosity average molecular weight: 40,000) are added to 80 parts by weight of chlorobenzene and dissolved therein. As a result, a charge transport layer-forming coating solution is obtained. This coating solution is coated on the charge generation layer, followed by drying at 130° C. for 40 minutes. As a result, a charge transport layer having a thickness of 25 μm is formed. In this way, an organic photoreceptor (non-coated photoreceptor (1)) is obtained.

Formation of Inorganic Protective Layer

Formation of Interfacial Layer

The third layer is formed on a surface of the non-coated photoreceptor (1) using a film forming device having the configuration illustrated in FIGS. 4A and 4B.

First, the non-coated photoreceptor (1) is placed on the substrate support member 213 in the film forming chamber 210 of the film forming device. Then, the inside of the film forming chamber 210 is evacuated through the exhaust port 211 until the pressure reaches 0.1 Pa.

Next, He-diluted 40% oxygen gas (3.5 sccm) and $H_2$ gas (100 sccm) are introduced from the gas introduction tube 220 into the high-frequency discharge tube 221 provided with the plate electrode 219 having a diameter of 85 mm. 13.56 MHz radio waves are set to a power of 200 W by the high-frequency power supply 218 and a matching circuit (not illustrated in FIGS. 4A and 4B), and matching is performed using a tuner. An electric discharge is caused from the plate electrode 219. At this time, the power of reflected wave is 0 W.

Next, trimethylgallium gas (5 sccm) is introduced from the shower nozzle 216 into the plasma diffusion portion 217, provided inside the film forming chamber 210, through the gas introduction tube 215. At this time, the reaction pressure in the film forming chamber 210 is 10 Pa when measured using a Baratron vacuum gauge.

In this state, a film is formed on for 15 minutes while rotating the non-coated photoreceptor (1) at a speed of 100 rpm. As a result, an interfacial layer having thickness of 0.21 μm is formed on a surface of the charge transport layer of the non-coated photoreceptor (1).

Formation of Intermediate Layer

Next, a high-frequency discharge is stopped. Using He-diluted 40% oxygen gas (10 sccm), a high-frequency discharge is started again.

In this state, a film is formed for 60 minutes while rotating the non-coated photoreceptor (1), on which the interfacial layer is formed, at a speed of 100 rpm. As a result, an intermediate layer having thickness of 1.0 μm is formed on the interfacial layer.

Formation of Outermost layer.

Next, a high-frequency discharge is stopped. Using He-diluted 40% oxygen gas (2.2 sccm), $H_2$ gas (300 sccm), and trimethylgallium gas (3.2 sccm), a high-frequency discharge is started again under a pressure in the film forming chamber 210 of 5 Pa.

In this state, a film is formed for 55 minutes while rotating the non-coated photoreceptor (1), on which the interfacial layer and the intermediate layer are sequentially formed, at a speed of 100 rpm. As a result, an outermost layer having a thickness of 0.52 μm is formed on the intermediate layer.

Through the above-described steps, an electrophotographic photoreceptor is obtained in which the undercoat layer, the charge generation layer, the charge transport layer, and the inorganic protective layer are sequentially formed on the conductive substrate.

Examples 2 to 7 and Comparative Examples 1 to 3

An interfacial layer, an intermediate layer, and an outermost layer are sequentially formed on the non-coated photoreceptor (1) in the same preparation method as that of Example 1, except that film forming conditions are changed according to Tables 1 and 2, for example, gas supply amounts of He-diluted 40% oxygen gas (represented by $O_2$/He), hydrogen gas (represented by $H_2$), trimethylgallium gas (represented by TMG), and dimethyl zinc gas (represented by DMZn), high-frequency power (represented by rf Power), pressure in the film forming chamber 210 (represented by Film Forming Pressure), and film formation time. As a result, an inorganic protective layer is formed. In this way, an electrophotographic photoreceptor is obtained.

Evaluation

Evaluation for Properties

Measurement of Volume Resistivity in Each Layer of Inorganic Protective Layer

The volume resistivity of each layer (interfacial layer, intermediate layer, and outermost layer) of the inorganic protective layer, which is a measurement target, is measured with the previously described method using a measurement sample which is prepared by forming each layer on an aluminum-deposited PET film under the same conditions as those under which each layer of the electrophotographic photoreceptor is prepared in each example; and forming a gold electrode by vapor deposition.

Composition of Each Layer of Inorganic Protective Layer

In order to measure the composition of each layer (interfacial layer, intermediate layer, and outermost layer), which is a measurement target, the ratio [O/Ga] of the number of oxygen atoms to the number of gallium atoms is measured using Rutherford backscattering spectrometry (RBS), Hydrogen forward scattering spectrometry (HFS), and energy dispersive X-ray spectroscopy (EDS).

In order to measure the compositions of the inorganic protective layer, an outer peripheral surface of the obtained electrophotographic photoreceptor is measured for the outermost layer; and an outer peripheral surface of the obtained electrophotographic photoreceptor is cut and an exposed portion of each layer is measured for the interfacial layer and the intermediate layer.

In the item "[Ga]+[O]+[H]" of Tables 3 and 4, the total elemental component ratio of gallium (Ga), oxygen (O), and hydrogen (H) in each layer (ratio with respect to all the elemental components of each layer) is shown. The value "1" corresponds to 100 at %.

In the item "[Ga]+[Zn]+[O]+[H]" of Tables 3 and 4, the total elemental component ratio of gallium (Ga), zinc (Zn), oxygen (O), and hydrogen (H) in each layer (ratio with respect to all the elemental components of each layer) is shown. The value "1" corresponds to 100 at %.

Experimental Evaluation

Image Blurring

The electrophotographic photoreceptor obtained in each example is mounted to DocuCenter Color a450, and 1000 halftone images having an image density of Cin 30% are printed on A3 paper at a line screen frequency of 200 lpi.

The halftone dots of the obtained image are observed using a microscope. The first printed image and the 1000th printed image are used for this evaluation. The results are shown in Table 2.

The evaluation criteria are as follows.

A: Halftone dots are observed, and abnormalities are not observed

B: Halftone dots are observed, but abnormalities such as deficient and surplus portions in some dots (to a degree to which there are no problems in practice)

C: Some halftone dots are observed and the other halftone dots are not observed (to a degree to which there are problems in practice)

D: Halftone dots are not observed at all

Residual Potential

The residual potential of the electrophotographic photoreceptor obtained in each example is evaluated as follows.

First, a surface of the electrophotographic photoreceptor, which is rotating at 40 rpm in a state of being charged to −700 V by a scorotron charging unit, is irradiated with exposure light (light source: semiconductor laser, wavelength: 780 nm, power: 5 mW) while scanning the surface of the electrophotographic photoreceptor. Then, a potential of the electrophotographic photoreceptor is measured using a surface potentiometer (Model 344, manufactured by Trek Japan Co., Ltd.) to investigate a potential state (residual potential) of the electrophotographic photoreceptor. This process is repeated 100 cycles, and a residual potential in the 100th cycle is measured.

The evaluation criteria are as follows (wherein numerical values are represented by absolute values).

A: Lower than 20 V

B: 20 V or higher and lower than 60 V

C: 60 V or higher and lower than 100 V

D: 100V or higher

Hereinafter, the evaluation results of each example are shown in Tables 3 and 4.

TABLE 1

| | | Film Forming Conditions of Inorganic Protective Layer | | | | | | |
|---|---|---|---|---|---|---|---|---|
| | | Gas Supply Amount [sccm] | | | | rf Power | Film Forming Pressure | Film Formation Time |
| | | $H_2$ | TMG | DMZn | $O_2$/He | [V] | [Pa] | [min] |
| Example 1 | Outermost Layer | 300 | 3.2 | 0 | 2.2 | 200 | 5 | 55 |
| | Intermediate Layer | 100 | 5 | 0 | 10 | 200 | 10 | 60 |
| | Interfacial Layer | 100 | 5 | 0 | 3.5 | 200 | 10 | 15 |
| Example 2 | Outermost Layer | 300 | 3.2 | 0 | 1.8 | 200 | 5 | 60 |
| | Intermediate Layer | 100 | 5 | 0 | 8 | 200 | 10 | 65 |
| | Interfacial Layer | 100 | 5 | 0 | 3 | 200 | 10 | 17 |
| Example 3 | Outermost Layer | 300 | 3.2 | 0 | 2.2 | 200 | 5 | 55 |
| | Intermediate Layer | 100 | 5 | 0 | 10 | 200 | 10 | 60 |
| | Interfacial Layer | 300 | 3.2 | 0 | 2.2 | 200 | 5 | 23 |
| Example 4 | Outermost Layer | 300 | 3.2 | 0 | 2.2 | 200 | 5 | 110 |
| | Intermediate Layer | 100 | 5 | 0 | 10 | 200 | 10 | 120 |
| | Interfacial Layer | 100 | 5 | 0 | 3.5 | 200 | 10 | 38 |
| Example 5 | Outermost Layer | 300 | 3.2 | 0 | 2.2 | 200 | 5 | 55 |
| | Intermediate Layer | 100 | 5 | 0 | 10 | 200 | 10 | 60 |
| | Interfacial Layer | 100 | 5 | 0 | 3.5 | 200 | 10 | 7 |
| Example 6 | Outermost Layer | 100 | 2.5 | 2.5 | 10 | 200 | 10 | 30 |
| | Intermediate Layer | 100 | 5 | 0 | 10 | 200 | 10 | 60 |
| | Interfacial Layer | 300 | 3.2 | 0 | 2.2 | 200 | 5 | 25 |
| Example 7 | Outermost Layer | 300 | 3.2 | 0 | 2.2 | 200 | 5 | 55 |
| | Intermediate Layer | 100 | 5 | 0 | 10 | 200 | 10 | 60 |
| | Interfacial Layer | 100 | 3 | 2 | 8 | 200 | 10 | 12 |

TABLE 2

| | | Film Forming Conditions of Inorganic Protective Layer | | | | | | |
|---|---|---|---|---|---|---|---|---|
| | | Gas Supply Amount [sccm] | | | | rf Power | Film Forming Pressure | Film Formation Time |
| | | $H_2$ | TMG | DMZn | $O_2$/He | [V] | [Pa] | [min] |
| Comparative Example 1 | Outermost Layer | 100 | 5 | 0 | 10 | 200 | 10 | 30 |
| | Intermediate Layer | 300 | 3.2 | 0 | 2.2 | 200 | 5 | 110 |
| | Interfacial Layer | 100 | 5 | 0 | 3.5 | 200 | 10 | 15 |
| Comparative Example 2 | Outermost Layer | 300 | 3.2 | 0 | 2.2 | 200 | 5 | 55 |
| | Intermediate Layer | 100 | 5 | 0 | 3.5 | 200 | 10 | 70 |
| | Interfacial Layer | 100 | 5 | 0 | 10 | 200 | 10 | 12 |
| Comparative Example 3 | Outermost Layer | 100 | 5 | 0 | 10 | 200 | 10 | 30 |
| | Intermediate Layer | 100 | 5 | 0 | 3.5 | 200 | 10 | 70 |
| | Interfacial Layer | 300 | 3.2 | 0 | 2.2 | 200 | 5 | 25 |

TABLE 3

| | | Properties of Inorganic Protective Layer | | | | | | | Evaluation | | |
|---|---|---|---|---|---|---|---|---|---|---|---|
| | | Volume Resistivity [Ω · cm] | Ratio (O/Ga) of Number of Atoms | [Ga] + [O] + [H] | [Ga] + [Zn] + [O] + [H] | Thickness [μm] | Resistance Relationship | Relationship of Composition Ratio of O/Ga | Image Blurring First Printed Image | Image Blurring 1000th Printed Image | Residual Potential |
| Example 1 | Outermost Layer | ρ3 = 3.3E+09 | C3 = 1.21 | 1 | 1 | 0.51 | ρ3 < ρ1 < ρ2 | C3 < C1 < C2 | A | A | B |
| | Intermediate Layer | ρ2 = 4.1E+10 | C2 = 1.42 | 0.98 | 0.98 | 1 | | | | | |
| | Interfacial Layer | ρ1 = 2.0E+10 | C1 = 1.31 | 0.96 | 0.96 | 0.21 | | | | | |
| Example 2 | Outermost Layer | ρ3 = 2.2E+09 | C3 = 1.15 | 1 | 1 | 0.51 | ρ3 < ρ1 < ρ2 | C3 < C1 < C2 | A | A | B |
| | Intermediate Layer | ρ2 = 3.0E+10 | C2 = 1.38 | 0.97 | 0.97 | 1.02 | | | | | |
| | Interfacial Layer | ρ1 = 8.7E+9 | C1 = 1.28 | 0.96 | 0.96 | 0.2 | | | | | |
| Example 3 | Outermost Layer | ρ3 = 3.3E+09 | C3 = 1.21 | 1 | 1 | 0.51 | ρ3 = ρ1 < ρ2 | C3 = C1 < C2 | A | A | B |
| | Intermediate Layer | ρ2 = 4.1E+10 | C2 = 1.42 | 0.98 | 0.98 | 1 | | | | | |
| | Interfacial Layer | ρ1 = 3.3E+09 | C1 = 1.21 | 1 | 1 | 0.22 | | | | | |
| Example 4 | Outermost Layer | ρ3 = 3.3E+09 | C3 = 1.21 | 1 | 1 | 1.04 | ρ3 < ρ1 < ρ2 | C3 < C1 < C2 | A | A | C |
| | Intermediate Layer | ρ2 = 4.1E+10 | C2 = 1.42 | 0.98 | 0.98 | 2 | | | | | |
| | Interfacial Layer | ρ1 = 2.0E+10 | C1 = 1.31 | 0.96 | 0.96 | 0.54 | | | | | |
| Example 5 | Outermost Layer | ρ3 = 3.3E+09 | C3 = 1.21 | 1 | 1 | 0.51 | ρ3 < ρ1 < ρ2 | C3 < C1 < C2 | A | B | A |
| | Intermediate Layer | ρ2 = 4.1E+10 | C2 = 1.42 | 0.98 | 0.98 | 1 | | | | | |
| | Interfacial Layer | ρ1 = 2.0E+10 | C1 = 1.31 | 0.96 | 0.96 | 0.1 | | | | | |
| Example 6 | Outermost Layer | ρ3 = 3.1E+9 | C3 = 2.75 | 0.78 | 0.98 | 0.5 | ρ3 < ρ1 < ρ2 | C1 < C2 < C3 | A | A | C |
| | Intermediate Layer | ρ2 = 4.1E+10 | C2 = 1.42 | 0.98 | 0.98 | 1 | | | | | |
| | Interfacial Layer | ρ1 = 3.3E+09 | C1 = 1.21 | 1 | 1 | 0.23 | | | | | |
| Example 7 | Outermost Layer | ρ3 = 3.3E+09 | C3 = 1.21 | 1 | 1 | 0.51 | ρ3 < ρ1 < ρ2 | C3 < C2 < C1 | A | B | B |
| | Intermediate Layer | ρ2 = 4.1E+10 | C2 = 1.42 | 0.98 | 0.98 | 1 | | | | | |
| | Interfacial Layer | ρ1 = 5.0E+09 | C1 = 2.37 | 0.82 | 0.98 | 0.2 | | | | | |

TABLE 4

| | | Properties of Inorganic Protective Layer | | | | | | | Evaluation | | |
|---|---|---|---|---|---|---|---|---|---|---|---|
| | | Volume Resistivity [Ω · cm] | Ratio (O/Ga) of Number of Atoms | [Ga] + [O] + [H] | [Ga] + [Zn] + [O] + [H] | Thickness [μm] | Resistance Relationship | Relationship of Composition Ratio of O/Ga | Image Blurring First Printed Image | Image Blurring 1000th Printed Image | Residual Potential |
| Comparative Example 1 | Outermost Layer | ρ3 = 4.1E+10 | C3 = 1.42 | 0.98 | 0.98 | 0.5 | ρ2 < ρ1 < ρ3 | C2 < C1 < C3 | A | A | D |
| | Intermediate Layer | ρ2 = 3.3E+09 | C2 = 1.21 | 1 | 1 | 1.04 | | | | | |
| | Interfacial Layer | ρ1 = 2.0E+10 | C1 = 1.31 | 0.96 | 0.96 | 0.21 | | | | | |

TABLE 4-continued

| | | Properties of Inorganic Protective Layer | | | | | | | Evaluation | | |
|---|---|---|---|---|---|---|---|---|---|---|---|
| | | | Ratio | | [Ga] + | | | | Image Blurring | | |
| | | Volume Resistivity [Ω · cm] | (O/Ga) of Number of Atoms | [Ga] + [O] + [H] | [Zn] + [O] + [H] | Thick-ness [μm] | Resistance Relationship | Relationship of Composition Ratio of O/Ga | First Printed Image | 1000th Printed Image | Residual Potential |
| Comparative Example 2 | Outermost Layer | ρ3 = 3.3E+09 | C3 = 1.21 | 1 | 1 | 0.51 | ρ3 < ρ2 < ρ1 | C3 < C2 < C1 | D | D | C |
| | Intermediate Layer | ρ2 = 2.0E+10 | C2 = 1.31 | 0.96 | 0.96 | 1 | | | | | |
| | Interfacial Layer | ρ1 = 4.1E+10 | C1 = 1.42 | 0.98 | 0.98 | 0.2 | | | | | |
| Comparative Example 3 | Outermost Layer | ρ3 = 4.1E+10 | C3 = 1.42 | 0.98 | 0.98 | 0.5 | ρ1 < ρ2 < ρ3 | C1 < C2 < C3 | A | A | D |
| | Intermediate Layer | ρ2 = 2.0E+10 | C2 = 1.31 | 0.96 | 0.96 | 1 | | | | | |
| | Interfacial Layer | ρ1 = 3.3E+09 | C1 = 1.21 | 1 | 1 | 0.23 | | | | | |

It can be seen from the above results that, when the Examples are compared to the Comparative Examples, superior results are obtained in the evaluations for both image blurring and residual potential.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an organic photosensitive layer that is provided on the conductive substrate; and an inorganic protective layer that is provided on the organic photosensitive layer, wherein the inorganic protective layer includes a first layer, a second layer, and a third layer in this order from the organic photosensitive layer side and satisfies the relationship of the following expression (1):

$$\rho 3 \leq \rho 1 < \rho 2 \qquad \text{Expression (1):}$$

wherein ρ1 represents a volume resistivity (Ω·cm) of the first layer, ρ2 represents a volume resistivity (Ω·cm) of the second layer, and ρ3 represents a volume resistivity (Ω·cm) of the third layer, wherein the first layer, the second layer, and the third layer of the inorganic protective layer each include gallium and oxygen, and wherein the first or the third layer of the inorganic protective laver includes gallium, oxygen, and zinc.

2. The electrophotographic photoreceptor according to claim 1, wherein the organic photosensitive layer contains a p-type charge-transporting organic material, and the inorganic protective layer contains an n-type or i-type charge-transporting inorganic material.

3. The electrophotographic photoreceptor according to claim 2, wherein the inorganic protective layer has a thickness of from 0.4 μm to 5.0 μm.

4. The electrophotographic photoreceptor according to claim 2, wherein the first layer has a thickness of from 0.05 μm to 1.0 μm.

5. The electrophotographic photoreceptor according to claim 2, wherein the inorganic protective layer satisfies the relationship of the following expression (2):

$$C3 \leq C1 < C2 \qquad \text{Expression (2):}$$

wherein C1 represents a ratio (oxygen/gallium) of the number of oxygen atoms to the number of gallium atoms in the first layer, C2 represents a ratio (oxygen/gallium) of the number of oxygen atoms to the number of gallium atoms in the second layer, and C3 represents a ratio (oxygen/gallium) of the number of oxygen atoms to the number of gallium atoms in the third layer.

6. The electrophotographic photoreceptor according to claim 1, wherein the inorganic protective layer has a thickness of from 0.4 μm to 5.0 μm.

7. The electrophotographic photoreceptor according to claim 1, wherein the first layer has a thickness of from 0.05 μm to 1.0 μm.

8. The electrophotographic photoreceptor according to claim 1, wherein the inorganic protective layer satisfies the relationship of the following expression (2):

$$C3 \leq C1 < C2 \qquad \text{Expression (2):}$$

wherein C1 represents a ratio (oxygen/gallium) of the number of oxygen atoms to the number of gallium atoms in the first layer, C2 represents a ratio (oxygen/gallium) of the number of oxygen atoms to the number of gallium atoms in the second layer, and C3 represents a ratio (oxygen/gallium) of the number of oxygen atoms to the number of gallium atoms in the third layer.

9. A process cartridge comprising an electrophotographic photoreceptor, wherein the electrophotographic photoreceptor is the electrophotographic photoreceptor according to claim 1.

10. The process cartridge according to claim 9, wherein the organic photosensitive layer of the electrophotographic photoreceptor contains a p-type charge-transporting organic material, and the inorganic protective layer of the electrophotographic photoreceptor contains an n-type or i-type charge-transporting inorganic material.

11. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image, formed on the surface of the electrophotographic photoreceptor, using a toner to form a toner image; and a transfer unit that transfers the toner image, formed on the surface of the electrophotographic photoreceptor, onto a recording medium, wherein the electrophotographic photoreceptor is the electrophotographic photoreceptor according to claim 1.

12. The image forming apparatus according to claim 11, wherein the organic photosensitive layer of the electrophotographic photoreceptor contains a p-type charge-transporting organic material, and the inorganic protective layer of the electrophotographic photoreceptor contains an n-type or i-type charge-transporting inorganic material.

* * * * *